US007485786B2

(12) United States Patent
Delatorre

(10) Patent No.: US 7,485,786 B2
(45) Date of Patent: Feb. 3, 2009

(54) PERCUSSION INSTRUMENT AND NOISEMAKING DEVICE

(76) Inventor: John Delatorre, 14318 Quiet Town Ln, Sugar Land, TX (US) 77478

( * ) Notice: Subject to any disclaimer, the term of this patent is extended or adjusted under 35 U.S.C. 154(b) by 117 days.

(21) Appl. No.: 11/402,131

(22) Filed: Apr. 11, 2006

(65) Prior Publication Data

US 2006/0230907 A1 Oct. 19, 2006

Related U.S. Application Data

(60) Provisional application No. 60/671,305, filed on Apr. 14, 2005.

(51) Int. Cl.
*G10D 13/08* (2006.01)

(52) U.S. Cl. ..... 84/402; 84/410

(58) Field of Classification Search ..... 84/402, 84/403, 404, 408–410
See application file for complete search history.

(56) References Cited

U.S. PATENT DOCUMENTS 186,169 A 1/1877 Rowbotham
3,783,733 A * 1/1974 Zirimis ..... 84/402
3,902,272 A 9/1975 Molenaar
4,075,922 A * 2/1978 Smith ..... 84/402
5,112,266 A 5/1992 Hall
D373,150 S 8/1996 Zaksenberg
D390,887 S * 2/1998 Gilbert et al. ..... D21/405
D392,000 S 3/1998 Rapp
5,984,761 A * 11/1999 Kalinowski ..... 446/421
2001/0034177 A1 10/2001 Hunn

* cited by examiner

*Primary Examiner*—Walter Benson
*Assistant Examiner*—Jianchun Qin
(74) *Attorney, Agent, or Firm*—Ariel S. Bentolila; Bay Area IP, llc

(57) ABSTRACT

A noisemaking devices are described, which may be a blade member having a handle joining portion at its base, a flexible plate member operable for making sound (e.g., low-pitched, clicking sounds and alternative, louder, high-pitched clicking sounds), the flexible plate member having an indention that is operable for producing a sound when the flexible plate member is flexed about the indention. A handle, an upper portion of which is joined to the flexible plate member and be pivotably joined to the blade such that the blade pivots when the handle is translated perpendicular to the plane of the blade, and the blade and the flexible plate member being oriented such that when the blade pivots, the blade causes the flexible plate member to flex and thereby make the sound.

13 Claims, 16 Drawing Sheets

PERCUSSION INSTRUMENT AND NOISEMAKING DEVICE

CROSS-REFERENCE TO RELATED APPLICATIONS

The present Utility patent application claims priority benefit of the U.S. provisional application for patent 60/671,305 filed on Apr. 14, 2005 under 35 U.S.C. 119(e).

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates to percussion instruments and noisemaking devices or cheering mechanisms, more particularly to hand-held percussion instruments and noisemaking devices or cheering mechanisms used to create a variety of sounds. Such percussion instruments and noisemakers are used by musicians, performers, sports fans, partygoers and others performing, celebrating or needing such devices or mechanisms to replace, simulate or supplement musical sounds, cheering, applause or other artificial or non-artificial sounds.

BACKGROUND OF THE INVENTION

Conventional percussion instruments include, without limitation, drums, tambourines, cowbells, cymbals, castanets, maracas, and wooden blocks. Percussion instruments used to create unconventional sounds include, without limitation, garbage cans, garbage can lines, metal pots and pans, washboards and hollow logs.

Handheld percussion instruments and noisemakers are found in concert halls, schools, sports stadiums, at New Year's celebrations, at birthday parties, and at a host of other events and special occasions. Musicians, performers, cheering fans and partygoers use percussion instruments and noisemakers to make more sounds, louder sounds and noise, and/or different sounds and noise than if, they were just using their voices or hands to create the same or similar sounds or noise. Percussion instruments and noisemakers can also assist a person's ability to make musical sounds or noise over longer periods with relative ease.

An example of a conventional handheld percussion instrument and noisemaker is the Smith instrument illustrated in U.S. Pat. No. 4,075,922, which is a sound-producing clapper assembly capable of producing, a soft pattering sound and an alternative, louder, rattling drum-roll noise. A limitation in Smith's design is that it only produces two distinct sounds. Furthermore, the majority of the sound generated cannot be projected in any one particular direction. The sound produced moves away from the device in a 360-degree pattern. This 360-degree pattern could project sound in the direction of people nearby who may find the noise undesirable.

Handheld noisemaking devices are disclosed in U.S. Pat. No. 5,984,761 issued to Kalinowski, in U.S. Design Pat. No. D373,150, issued to Zaksenberg and in U.S. Design Pat. No. D392,000 issued to Rapp. The Kalinowski, Zaksenberg, and Rapp designs are each noisemakers that use a handle to force multiple outer paddles to strike a center paddle creating sound. Zaksenberg and Rapp both designed their noisemakers with their outer paddles located closer to the center paddle. Kalinowski was able to show why the Zaksenberg and Rapp designs provided an insufficient amount of sound. Kalinowski successfully increased the sound of his design when he repositioned the paddles further away from his center paddle by relocating the pivot area.

Another example of a known noisemaker is disclosed by U.S. Pat. No. 20010034177 issued to Hunn, who describes a noisemaking device consisting of a head at tone end attached to a handle. The handle is at least partially hollow. A user is able to, at least partially create noise by filling the handle with various items like bells and balls and shaking the noisemaking device causing the contents to rattle off the inside of the handle. Because a person must hold the handle to use Hunn's noisemaking device, the person's hand may undesirably reduce the level of noise resonating from the device.

Hunn's noisemaking device like those illustrated earlier by Smith, Kalinowski, Zaksenberg and Rapp, project only a moderate amount of sound a short distance and mostly in a 360-degree pattern. Furthermore, the designs by Smith, Hunn, Kalinowski, Zaksenberg, and Rapp each produce generally only one or two sounds, either increasing or decreasing depending on the amount of effort used to activate the device.

Another example of a noisemaker is disclosed by U.S. Pat. No. 186,169 issued to Rowbotham, who describes a noisemaking device consisting of a steel box enclosing a flat steel plate that, when depressed, creates a clicking sound. U.S. army paratroopers used a similar device called a "cricket" during WWII to quietly communicate to one another during dangerous situations. Examples of the noisemaker are documented in books titled "D-Day: Jun. 6, 1944" by Stephen E. Ambrose; "D-Day: The Strategy, the Men, the Equipment" by Bernard C. Nulty; "D-Day: As They Saw It" by Lord Carver and many others. The "cricket" was first a toy before the military made it part of their lifesaving equipment. Today a similar handheld device is used to train animals.

The "cricket" generally consisted of two pieces of steel; one served as the body of the noisemaking device and the other was usually a thin, flat, rectangular piece used to make the actual noise. The "cricket" requires a user to create noise by using their thumb or finger to bend the flat, rectangular piece of steel. The use of the user's thumb or finger to bend the steel plate could easily cause the muscles of their hand to become weak if operated for more than a short period. The device only produces two sounds; one when a user presses down on the steel plate and another slightly different sound when the user releases the steel plate.

Another example of a known noisemaker is disclosed by U.S. Pat. No. 3,902,272 issued to Molenaar, who illustrates a sound generating device similar to the "cricket", consisting of a steel box enclosing a piece of flat steel plate which when depressed creates a clicking sound. The difference between Molenaar's sound generating device and the "cricket" is how the steel plate is held firm inside the device. The "cricket" is designed so that only one end of the steel plate is allowed to bend. Molenaar's device is designed so that neither end of the steel plate is allowed to bend. Molenaar's device creates sound by bending the middle of the steel plate. A person using the device is required to use their finger to activate the steel plate by pressing down on the steel plate. The device, like the "cricket" is only able to produce a limited amount of sound and project sound a short distance. Also, Molenaar's design creates limited sound because the user is required to press on the very area that produces the sound.

Furthermore, most past and present noisemakers used at parades, parties, sports arenas, and many other events are often provided to the public free of charge. Numerous companies purchase noisemakers to advertise their names and logos in hopes of generating future business. Many of the noisemakers purchased are made of materials that limit the size of a company's name and logo to one color. Many of these noisemakers also limit the amount of space available for advertising. An advertiser needs a noisemaker that is made with a material that can allow for using several colors and a larger imprint area for advertising. A noisemaker that offers multiple color imprinting and a larger imprint area at prices similar to a competitor's noisemaker is a tremendous advantage to the advertiser.

In view of the foregoing, there is a need for an improved handheld noisemaker that is able to create a variety of sounds, that is able to direct the sound in a particular direction and that is easy to use. There is also a need for a noisemaker that can be made of a material that can be imprinted with several colors, and that provides a substantial imprint area advertising.

BRIEF DESCRIPTION OF THE DRAWINGS

The present invention is illustrated by way of example, and not by way of limitation, in the figures of the accompnaying drawings and in which like reference numerals refer to similar elements and in which:

FIG. 3 is a front view, and FIG. 4 is a side view;

FIG. 5 shows an exemplary handle. FIG. 6 shows a top view of the handle. FIG. 7 shows an exemplary paddle. FIG. 8 shows an exemplary flexible plate, and FIG. 9 shows an exemplary brace;

FIG. 10 shows a top view of the exemplary flexible plate, and FIG. 11 shows a side, angled, and top view of the exemplary flexible plate being held by a user;

FIG. 12 illustrates, by way of example and not by way of limitation, the brace as the paddle is inserted into the brace. FIG. 13 illustrates, by way of example and not by way of limitation, the brace attached to the top of the handle. FIG. 14 illustrates, by way of example and not by way of limitation, a view looking down inside the top of the handle;

FIG. 15 shows the paddle in the forward position; FIG. 16 shows the paddle in the neutral position; and FIG. 17 shows the paddle in the backward position;

FIG. 19 illustrates backward movement; FIG. 20 illustrates forward movement; and FIG. 21 illustrates forward and backward movement;

FIG. 24 shows a view with the paddle in the forward position: FIG. 25 shows the paddle in the neutral position; and FIG. 26 shows the paddle in the backward position;

FIG. 27 shows the paddles in the forward position; FIG. 28 shows the paddles in the neutral position; and FIG. 29 shows the paddles in the backward position;

FIG. 30 shows the paddle in the forward position; FIG. 31 shows the paddle in the neutral position; and FIG. 32 slows the paddle in the backward position;

FIG. 33 shows the paddle in the forward position; FIG. 34 shows the paddle in the neutral position; and FIG. 35 shows the paddle in the backward position;

FIG. 36, FIG. 37 and FIG. 38 shows a side view of the device, and FIG. 39 shows the front view of the device;

FIG. 40 shows the paddle in the neutral position; FIG. 41 shows the paddle moving in the direction of the backward position; FIG. 42 shows the paddle in the backward position; FIG. 43 shows the paddle in the neutral position; FIG. 44 shows the paddle moving in the direction of the forward position; and FIG. 45 shows the paddle in the forward position.

Figure 1:
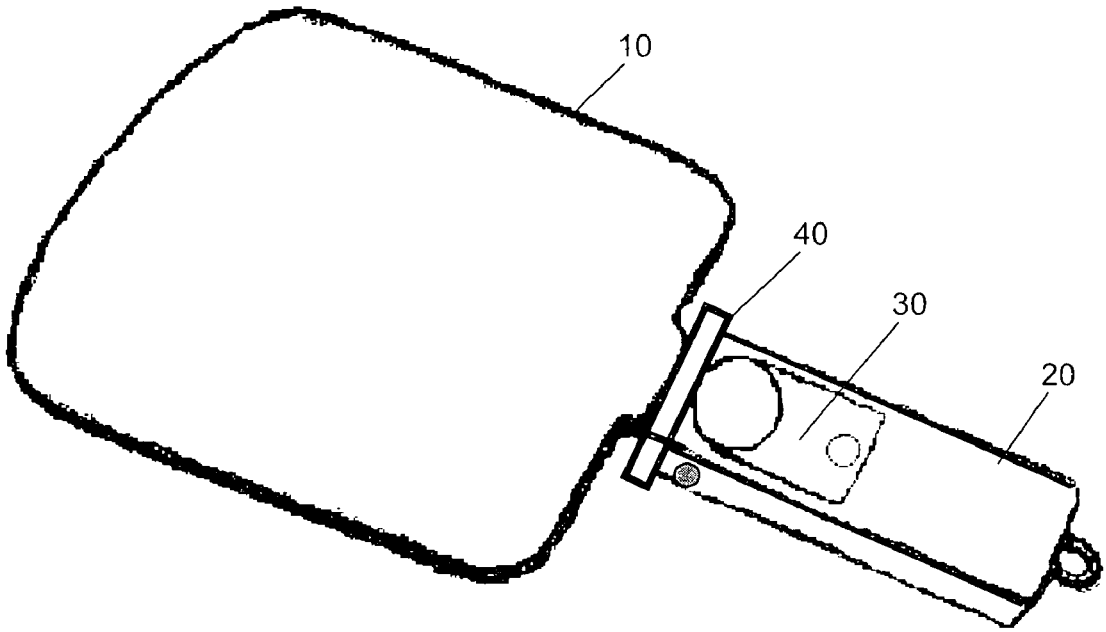
FIG. 1 is an environmental view of an exemplary percussion instrument and noisemaking device, according, to an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of percussion instruments and noisemaking devices are described.

An embodiment of the present invention is comprised of a blade member having a handle joining portion at its base, a flexible plate member operable for making sound (e.g., without limitation, low-pitched, clicking sounds and alternative, louder, high-pitched clicking sounds), the flexible plate member having an indention that is operable for producing a sound when the flexible plate member is flexed about the indention, and a handle, an upper portion of which is configured to receive and joined to a lower portion of the flexible plate member and be pivotably joined to a lower portion of the blade such that the blade pivots when the handle is translated perpendicular to the plane of the blade, and the blade and the flexible plate member being oriented such that when the blade pivots, the blade causes the flexible plate member to flex and thereby make a sound.

In an embodiment of the present invention, the lower portion of the flexible plate member is a generally narrow protruding neck that is operable to be received into the handle, which may optionally further include a pivoting mechanism in which the neck including at least one pivot joint member and the handle including a complementary pivoting joint receiving member, both of which properly mate for pivotably joining the blade to the handle. In alternate embodiment of the present inventions the pivoting location of the pivoting mechanism is adjustable such that at least one alternate sound is produced by making the neck cause a different contact point with an inside front part of the handle. In an embodiment of the present invention, the upper handle portion includes at least one hole generally opening in the direction of the translation, at least one hole being operable for channeling in the direction of translation any sound produced by the flexible plate. In an embodiment of the present invention, the blade is further a generally elongated member having an object joined thereto; which objects may optionally be shaped as a flag, a football, a pennant, a baseball, a bottle, a can of beer or other suitable object. A bracing member is further included in some embodiment of the present invention, which member braces the upper handle portion such that the bracing member is operable to strengthen the top of the upper handle portion from breakage when the handle is normally translated forwards and/or backwards.

In alternate embodiments of the present invention, means are provided to perform the foregoing functions.

In an embodiment of the present invention, the flexible plate member, the indention, and the lower blade portion pivotal joining all are cooperatively configured together such that a gentle flapping handle translation motion causes the flexible plate member to produce a first set of one or more sounds, while a more vigorous flapping handle translation motion causes the flexible plate member to produce a second set of one or more sounds.

Another embodiment of the present invention further includes another flexible plate member disposed on an opposite side of the blade such that the blade causes the other flexible plate member to flex and thereby make a sound when the blade pivots to an opposite extreme.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognized a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate and alternatives embodiments do not necessarily imply that the two are mutually exclusive.

The present invention will now be described in detail with reference to embodiments thereof as illustrated in the accompanying drawings.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

FIG. 1 is an environmental view of an exemplary percussion instrument and noisemaking device, according to an embodiment of the present invention. As shown by way of example, and not by way of limitation, in FIG. 1, a percussion instrument and noisemaker made in accordance with the present invention comprises four elements, shown separately in FIG. 2.

Figure 2:
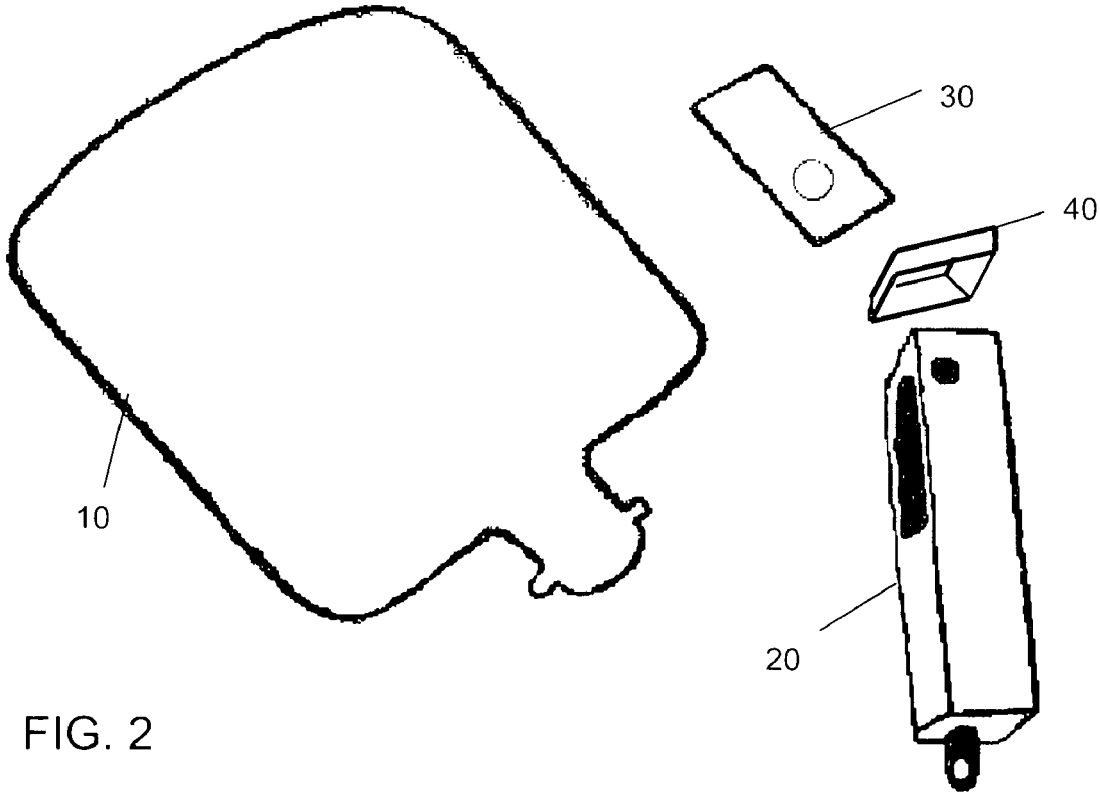
FIG. 2 is an exploded view of the exemplary percussion instrument and noisemaking device illustrated in FIG. 1, according to an embodiment of the present invention.

FIG. 2 is an exploded view of the exemplary percussion instrument and noisemaking device illustrated in FIG. 1, according to an embodiment of the present invention. In the present embodiment, the noisemaking device comprises a paddle 10, a handle 20, a flexible plate 30, and a brace 40. Elements of the noisemaking device may be constructed of a variety of materials. Handle 20 may be constructed of plastic, metal, wood, etc. In the preferred embodiment, handle 20 is made of acrylonitrile butadiene styrene. Paddle 10 may be constructed of any durable material that can be imprinted with advertisements or logos, such as, but not limited to, wood, metal, plastic, etc. In the preferred embodiment, paddle 10 is made of polypropylene. Flexible plate 30 may be constructed of any durable, flexible material such as, but not limited to, metal or plastic. In the preferred embodiment, flexible plate 30 is constructed of spring steel.

Figure 3:
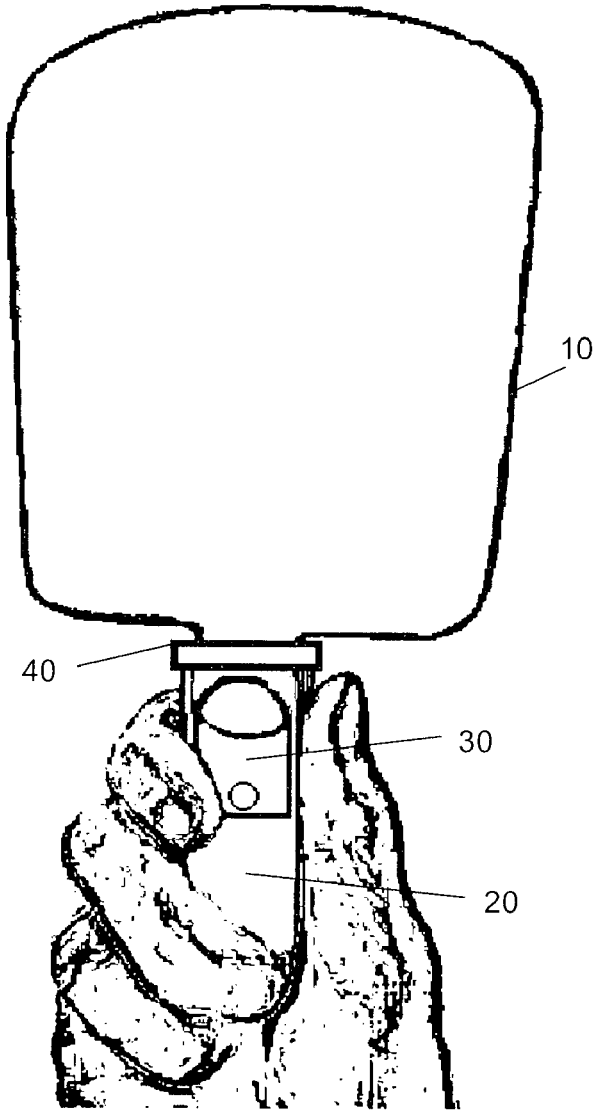
FIG. 3 and FIG. 4 illustrate an exemplary percussion instrument and noisemaking device being held by a user, according to an embodiment of the present invention.
Figure 4:
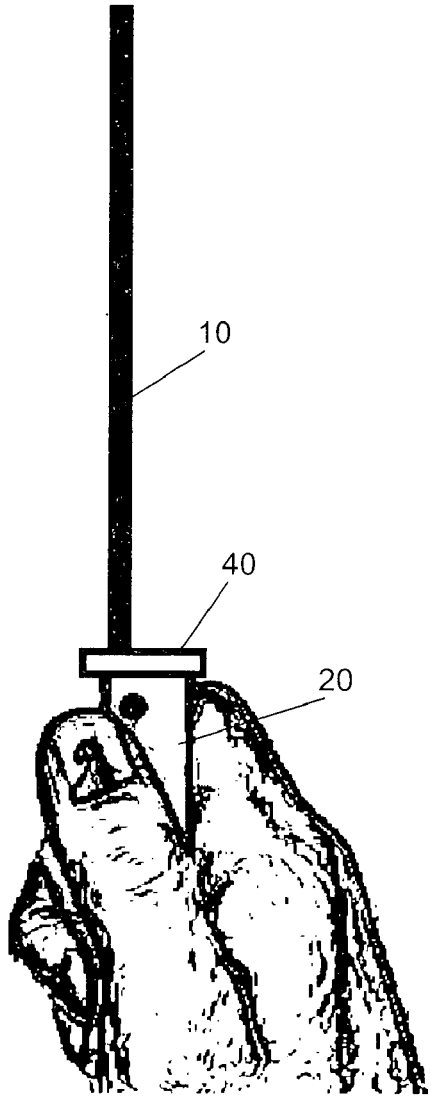

FIG. 3 and FIG. 4 illustrate an exemplary percussion instrument and noisemaking device being held by a user, according to an embodiment of the present invention. FIG. 3 is a front view, and FIG. 4 is a side view.

Figure 7:
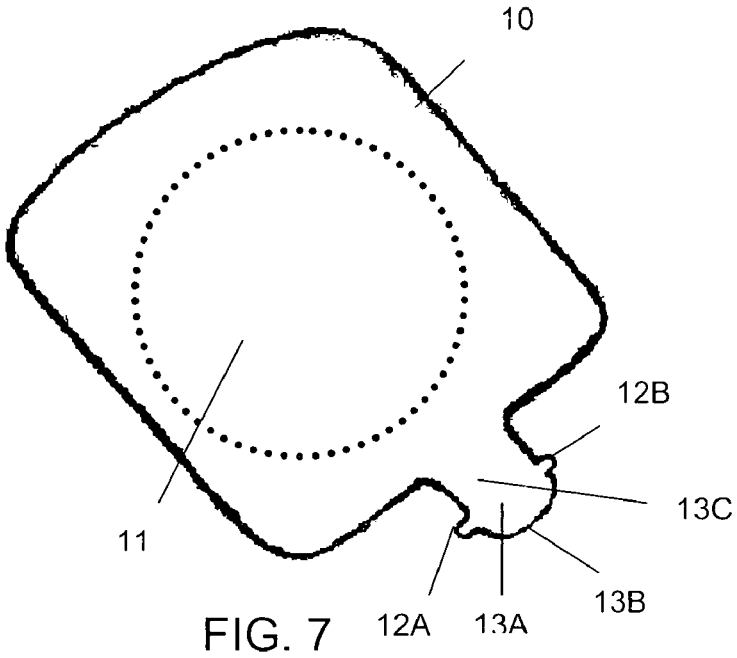
FIG. 5, FIG. 6, FIG. 7, FIG. 8, and FIG. 9 are detailed views of exemplary components of an exemplary percussion instrument and noisemaking device, according to an embodiment of the present invention.
Figure 8:
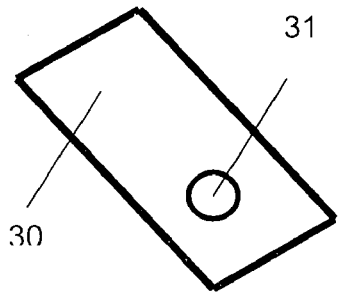
Figure 9:
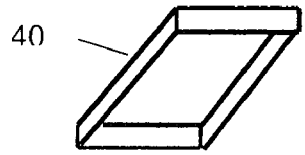
Figure 5:
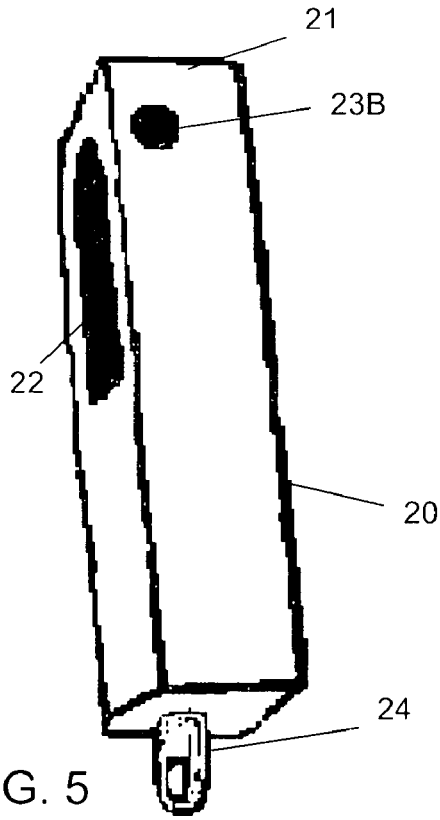
Figure 6:
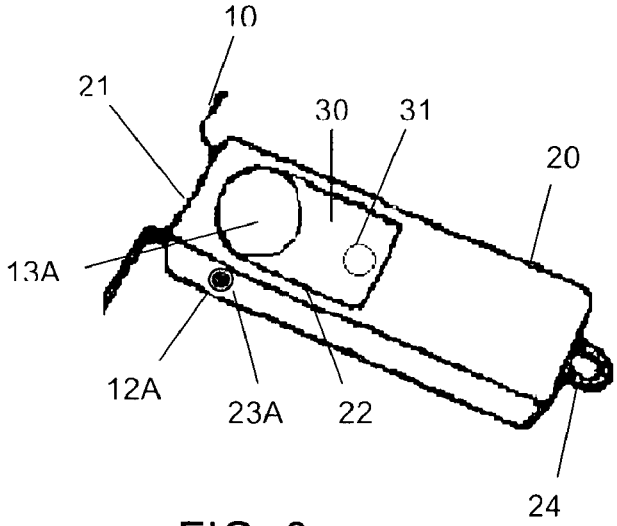

FIG. 5, FIG. 6. FIG. 7, FIG. 8, and FIG. 9 are detailed views of exemplary components of an exemplary percussion instrument and noisemaking device, according to an embodiment of the present invention. FIG. 5 shows exemplary handle 20.

Figure 23:
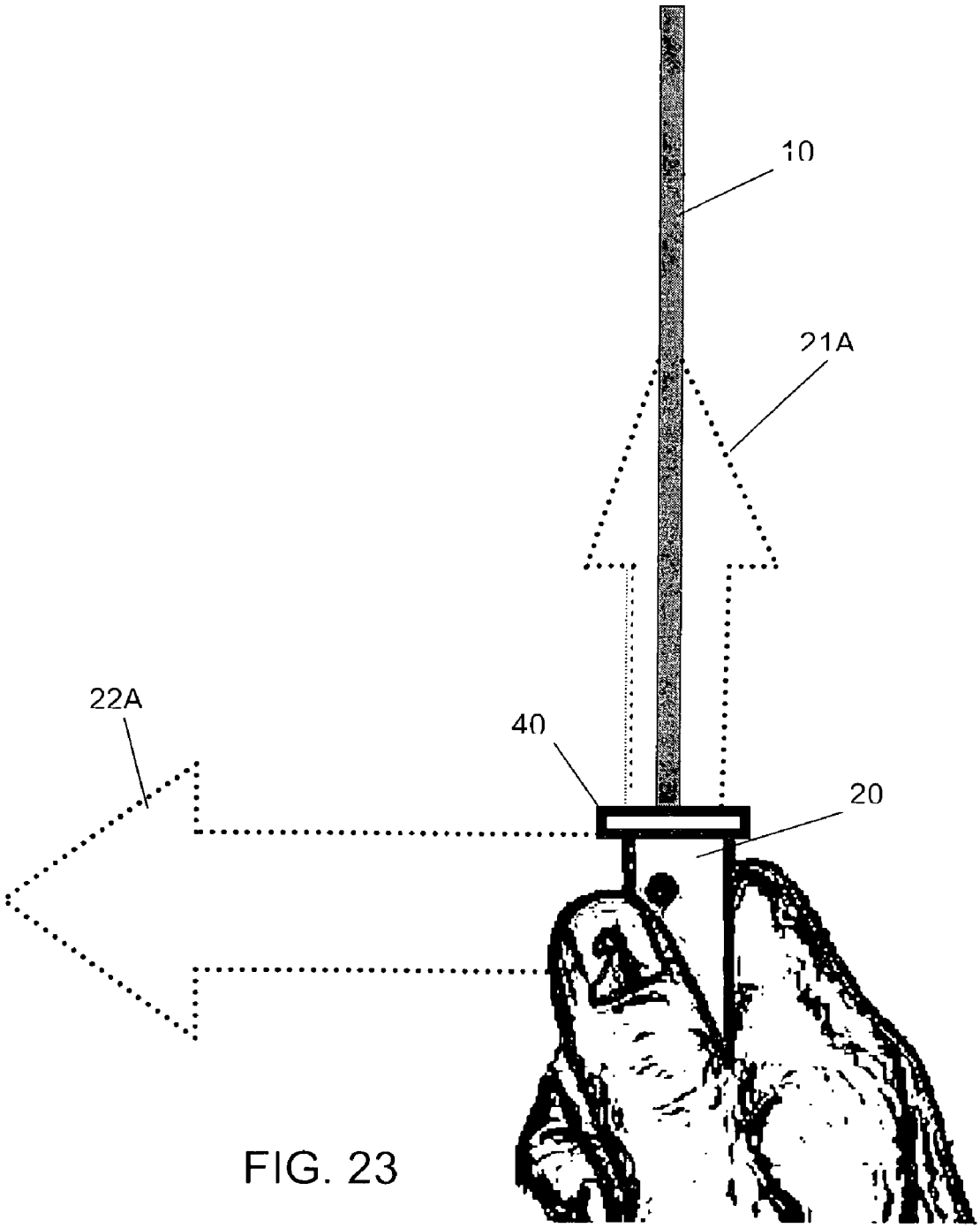
FIG. 23 illustrates the sound flow from an exemplary percussion instrument and noisemaking device, according to an embodiment of the present invention.

FIG. 6 shows a top view of handle 20. FIG. 7 shows exemplary paddle 10. FIG. 8 shows exemplary flexible plate 30, and FIG. 9 shows exemplary brace 40. FIG. 5 illustrates, by way of example and not by way of limitation, handle 20 including, without limitation, a top opening 21, a front opening 22, a pivot hole 23B, and a wrist strap holder 24. The noise generated is able to escape the device through top opening 21 and front opening 22, as shown in FIG. 23. In one suitable implementation, handle 20 measures 75 cm in height, 26 cm in length, and 17 cm in width, and front opening 22 measures 35 cm in height and 20 cm in width. However, alternate measurements for handle 20 and front opening 22 would be suitable depending upon the needs of the particular application.

FIG. 6 illustrates, by way of example and not by limitation, a neck 13A of paddle 10 inserted into top opening 21 of handle 20. In the present embodiment, attaching paddle 10 to handle 20 involves inserting a pivot 12A, shown in FIG. 7, into a pivot hole 23A and inserting a pivot 12B, shown in FIG. 7, into pivot hole 23B, as shown in FIG. 5. FIG. 6 also illustrates, by way of example and not by way of limitation, flexible plate 30 inside of handle 20, an indention 31 in flexible plate 30, and wrist strap holder 24. In the preferred embodiment, pivot holes 23A and 23B of handle 20 measure 4 cm in diameter, and the center of pivot holes 23A and 23B of handle 20 are located 5 cm from top opening, 21 of handle 20 and 8 cm from front opening 22. However, alternate measurements would also be suitable.

FIG. 7 illustrates, by way of example and not by way of limitation, a detailed view of paddle 10, which comprises an imprint area 11 for displaying advertising, product logos, and/or other information. FIG. 7 also illustrates pivot 12A, pivot 12B and neck 13A of paddle 10, a forward pressure point 13B and a backward pressure point 13C located on the backside of neck 13A of paddle 10. See FIG. 9 and FIG. 10 for a more detailed description of forward pressure point 13B and backward pressure point 13C. In the present embodiment, paddle 10 is large enough that imprint area 11 provides adequate space for advertisements and logos. In the preferred embodiment, paddle 10 measures 15.5 cm in height, 11 cm in length, and 0.3 cm in width, and neck 13A of paddle 10 measures 2.2 cm in height, 2.2 cm in length, and 0.3 cm in width. However, alternate embodiments may be made in various sizes.

FIG. 8 illustrates, by way of example and not by way of limitation, flexible plate 30, and indention 31. In the preferred embodiment, flexible plate 30 measures 4.7 cm in height, 2.2 cm in length, and 0.02 cm in width. Also, in the preferred embodiment, the center point of indention 31 of flexible plate 30 is located 2.9 cm from the longest edge of flexible plate 30 and 1.8 cm from the shortest edge of flexible plate 30, and indention 31 measures 0.06 cm in diameter. However, in alternate embodiments, these dimensions may be altered.

Figure 15:
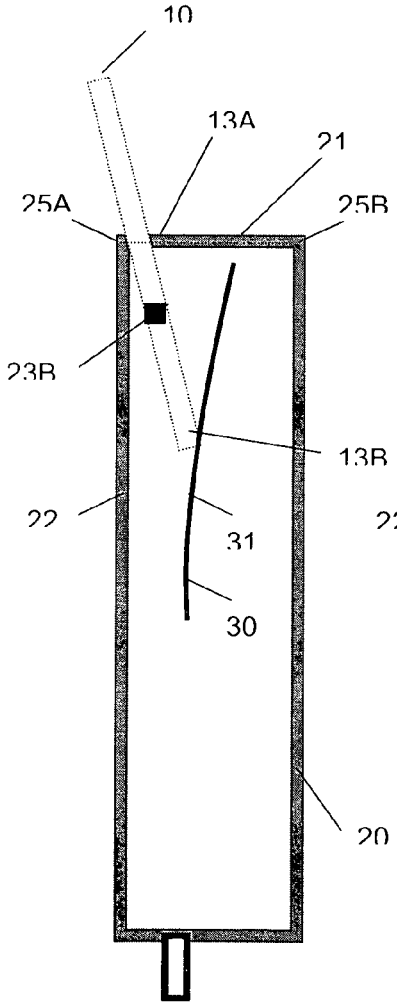
FIG. 15, FIG. 16, and FIG. 17 are interior views of an exemplary percussion instrument and noisemaking device, according to an embodiment of the present invention.

FIG. 9 illustrates, by way of example and not limitation, brace 40. Brace 40 is used to reinforce the strength of handle 20 when neck 13A of paddle 10 makes contact with the front inside edge of handle 20, as shown in FIG. 15. In the preferred embodiment, brace 40 measures 0.4 cm in height, 3.1 cm in length, and 2.1 cm in width, but alternate measurements would be suitable. Brace 40 may be constructed of any durable material such as, but not limited to plastic, metal or wood. In the preferred embodiment, brace 40 is made of acrylonitrile butadiene styrene.

Figure 10:
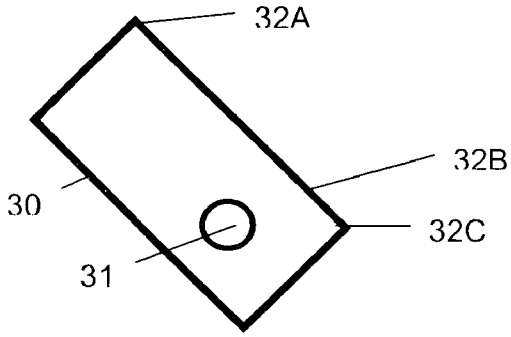
FIG. 10 and FIG. 11 show an exemplary flexible plate from a percussion instrument and noisemaking device, according to an embodiment of the present invention.
Figure 11:
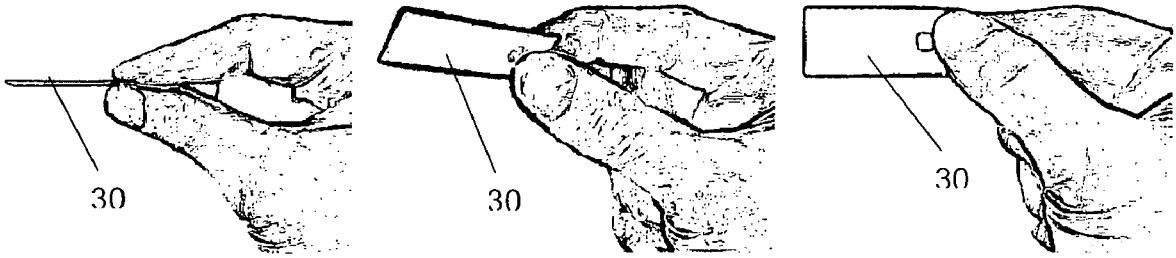

FIG. 10 and FIG. 11 show exemplary flexible plate 30 from a percussion instrument and noisemaking device, according to an embodiment of the present invention. FIG. 10 shows a top view of flexible plate 30, and FIG. 11 shows a side, angled, and top view of flexible plate 30 being held by a user. FIG. 10 shows, by way of example and not limitation, flexible plate 30, indention 31, flexible plate 30, and a flexible area extending from a point 32A to a point 32B of flexible plate 30 that is able to bend when paddle 10 exerts pressure on flexible plate 30. FIG. 10 also illustrates an area from point 32B to a point 32C of flexible plate 30 that is held in a fixed position inside handle 20 and not able to bend when paddle 10 exerts pressure on flexible plate 30. FIG. 11 illustrates, by way of example, the size of flexible plate 30 relative to a user's hand. In the preferred embodiment, flexible plate 30 is generally a thin, flat rectangular shaped surface having small indention 31 located at one end.

Figure 12:
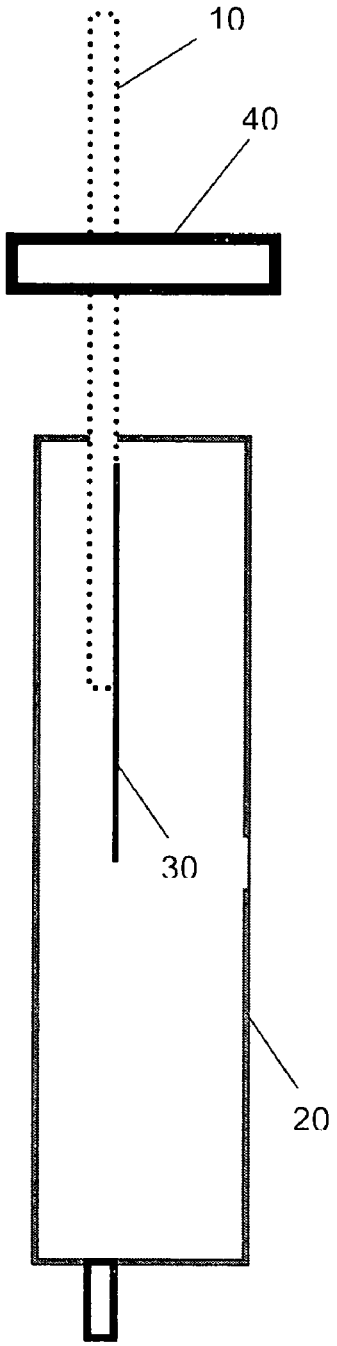
FIG. 12, FIG. 13, and FIG. 14 illustrate an exemplary brace from a percussion instrument and noisemaking device, according to an embodiment of the present invention.
Figure 13:
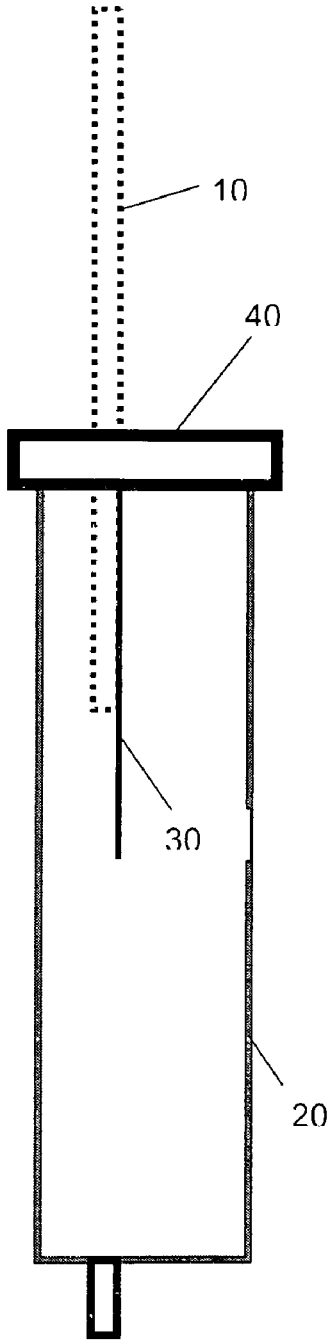
Figure 14:
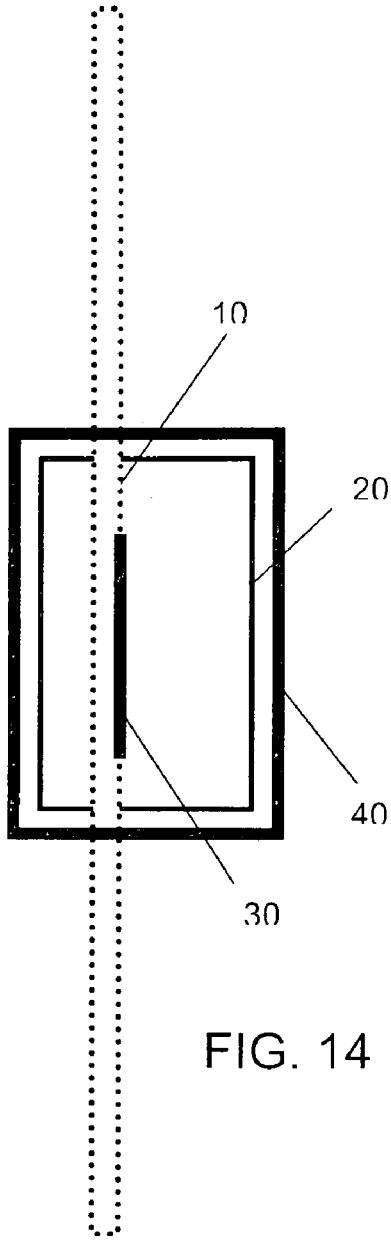

FIG. 12, FIG. 13, and FIG. 14 illustrate an exemplary brace from a percussion instrument and noisemaking device, according to an embodiment of the present invention. FIG. 12 illustrates, by way of example and not by way of limitation, brace 40 as paddle 10 is inserted into brace 40. FIG. 13 illustrates, by way of example and not by way of limitation, brace 40 attached to the top of handle 20. FIG. 14 illustrates, by way of example and not by way of limitation, a view looking down inside the top of handle 20. In the present embodiment, paddle 10 and flexible plate 30 are inserted into handle 20. Brace 40 is attached to the top of handle 20. Flexible plate 30 is seated against paddle 10.

Figure 16:
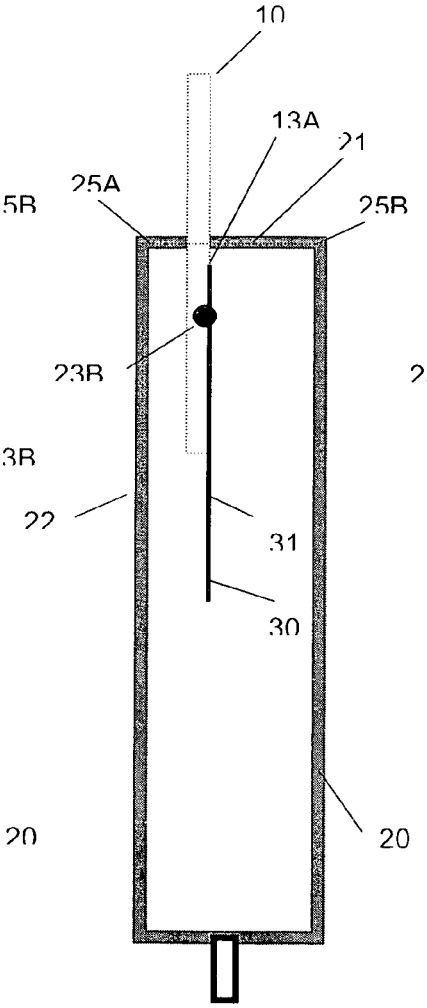
Figure 17:
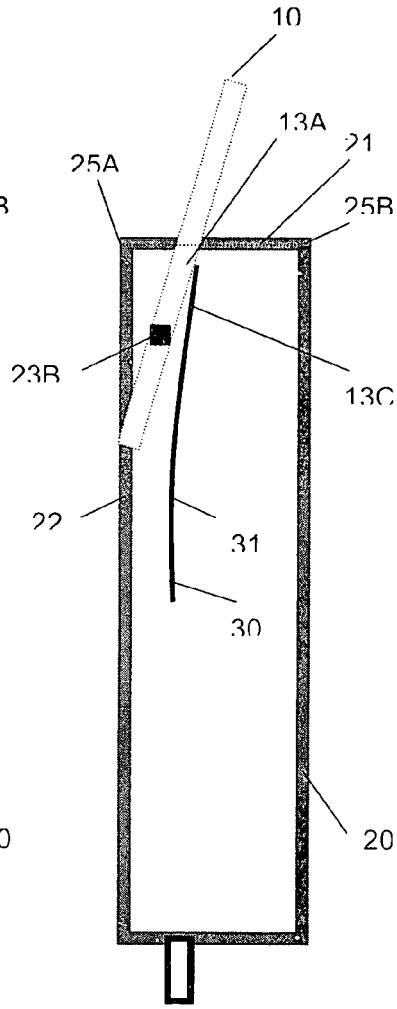

FIG. 15, FIG. 16, and FIG. 17 are interior views of an exemplary percussion instrument and noisemaking device, according to an embodiment of the present invention. FIG. 15 shows paddle 10 in the forward position; FIG. 16 shows paddle 10 in the neutral position; and FIG. 17 shows paddle 10 in the backward position. FIG. 15 illustrates, by way of example and not by way of limitation, an interior view of neck 13A of paddle 10 inserted into handle 20. In this illustration, neck 13A of paddle 10, while in the forward position, makes contact with a top inside front edge 25A of handle 20 causing paddle 10 to bend flexible plate 30 at forward pressure point 13B causing indention 31 to create a sound. FIG. 16 illustrates how neck 13A of paddle 10 while in the neutral position also allows for flexible plate 30 to remain in the neutral position. FIG. 17 illustrates how neck 13A of paddle 10, while in the backward position, does not make contact with a top inside back edge 25B of handle 20 causing paddle 10 to bend flexible plate 30 at backward pressure point 13C causing indention 31 to create a sound.

There is a difference in how flexible plate 30 is bent in FIG. 15 compared to FIG. 17. This difference is a result of how neck 3A of paddle 10 bends flexible plate 30. Indention 31 reacts to forward pressure point 13B of neck 13A when paddle 10 moves forward as shown in FIG. 15, and indention 31 reacts to backward pressure point 13C of neck 13A when paddle 10 moves backward as shown in FIG. 17. By allowing neck 13A of paddle 10 to make contact with inside front edge 25A or handle 20 when paddle 10 moves forward, more pressure is exerted on flexible plate 30 compared to when neck 13A or paddle 10 is not making contact with inside back edge 25B. By not allowing neck 13A of paddle 10 to make contact with inside back edge 25B of handle 20 when paddle 10 moves backward, less pressure is exerted on flexible plate 30.

Figure 18:
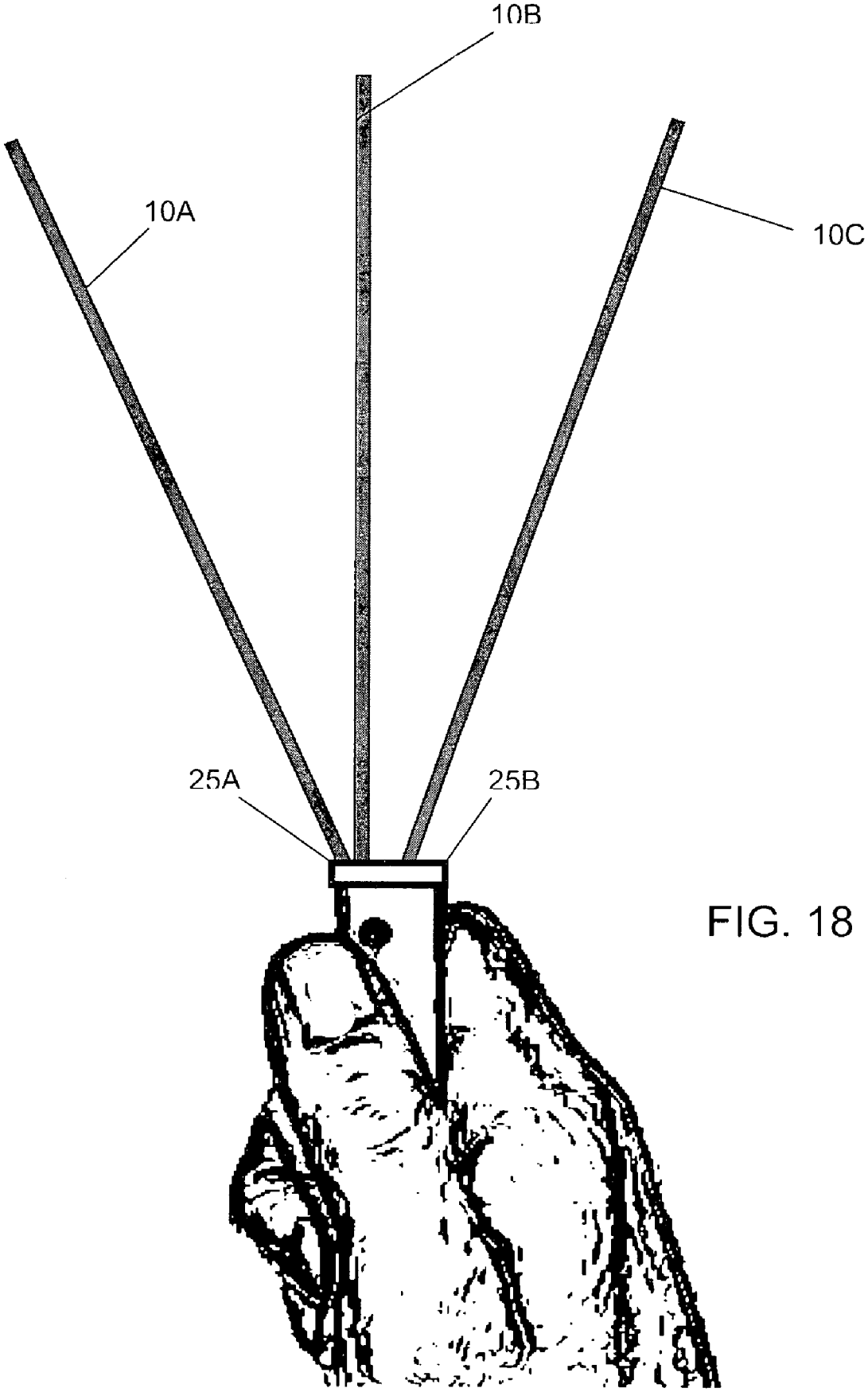
FIG. 18 illustrates an exemplary percussion instrument and noisemaking device while the paddle is in motion, in accordance with an embodiment of the present invention.

FIG. 18 illustrates an exemplary percussion instrument and noisemaking device while paddle 10 is in motion, in accordance with an embodiment of the present invention. FIG. 18 shows a forward motion of paddle 10 from a backward paddle position 10B to a forward paddle position 10A and a backward motion of paddle 10 from forward paddle position 10A to backward paddle position 10C. Paddle 10 moves in a forward motion from a center paddle position 10B to forward paddle position 10A eventually touching top inside front edge 25A of handle 20 where paddle 10 reaches its furthest forward limit, forward paddle position 10A, causing indention 31 of flexible plate 30 to create a sound. As paddle 10 moves in a backward motion from forward paddle position 10A to center paddle position 10C, the end of neck 13A of paddle 10, as shown in FIG. 7 and FIG. 15, releases the pressure on flexible plate 30 allowing flexible plate 30 to return to its previous shape, as shown in FIG. 16, creating a second slightly different sound. A third sound is created when paddle 10 moves in a backward motion from center paddle position 10B to backward paddle position 10C eventually reaching the furthest backward limit, backward paddle position 10C, causing indention 31 of flexible plate 30 to create a sound. As paddle 10 moves in a forward motion from backward paddle position 10C to center paddle position 10B, the tipper part of neck 13A, as shown in FIG. 7 and FIG. 17, releases the pressure on flexible plate 30, allowing indention 31 of flexible plate 30 to return to its previous shape, as shown in FIG. 16, creating a fourth slightly different sound.

The four different sound characteristics mentioned earlier may be created, by way of example, and not limitation, in the following manners: when paddle 10 moves from center paddle position 10B to forward paddle position 10A, when paddle 10 moves from forward paddle position 10A to center paddle position 10B; when paddle 10 moves from center paddle position 10B to backward paddle position 10C; and when paddle 10 moves from backward paddle position 10C to center paddle position 10B.

Figure 19:
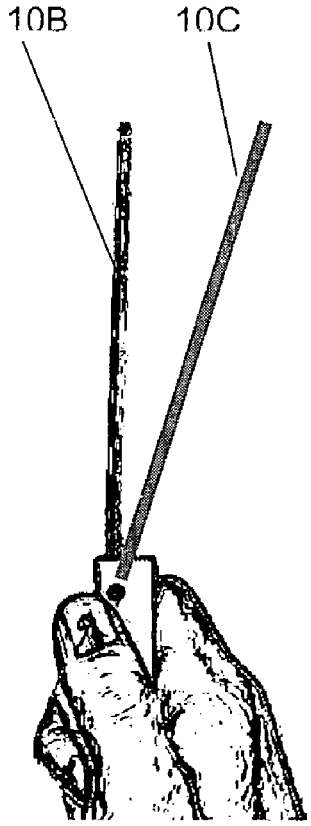
FIG. 19, FIG. 20, and FIG. 21 are motion views of an exemplary percussion instrument and noisemaking device, according to an embodiment of the present invention.
Figure 20:
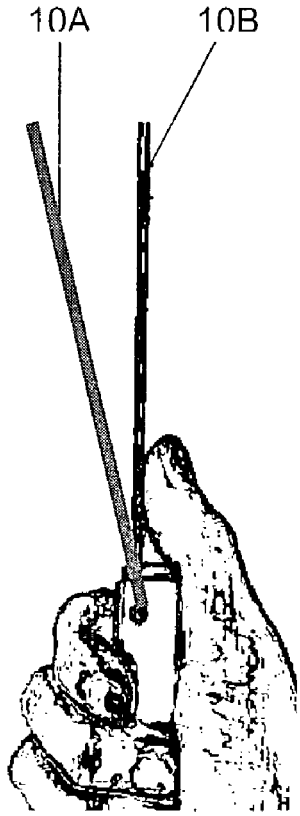
Figure 21:
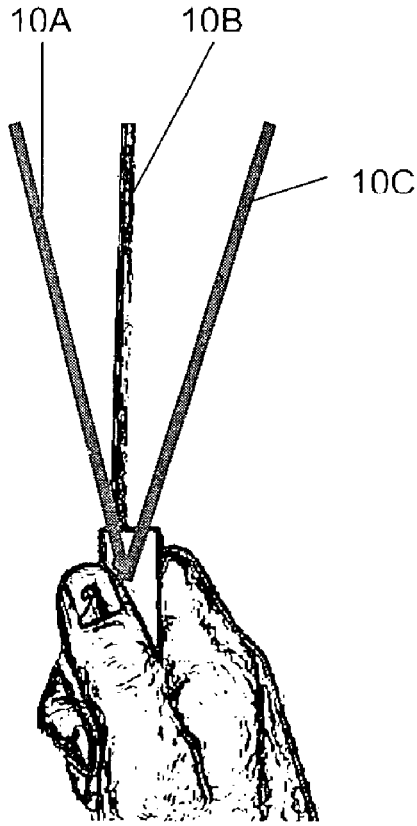

FIG. 19, FIG. 20, and FIG. 21 are motion views of an exemplary percussion instrument and noisemaking device, according to an embodiment of the present invention. FIG. 19 illustrates backward movement; FIG. 20 illustrates forward movement; and FIG. 21 illustrates forward and backward movement. FIG. 19 illustrates, by way of example and not by way of limitation, how a user can use the present embodiment to make one series of sounds by moving paddle 10 back and forth between center paddle position 10B and backward paddle position 10C. FIG. 20 illustrates, by way of example and not by way of limitation, how a user can use the device to make a second series of sounds by moving paddle 10 back and forth between forward paddle position 10A and center paddle position 10B. In this example, a user is required to brace the backside of paddle 10 with their thumb to keep paddle 10 from moving to backward paddle position 10C. FIG. 21 illustrates, by way of example and not by way of limitation, how a user can use the device to make a third series of sounds by moving paddle 10 back and forth between forward paddle position 10A and backward paddle position 10C.

Figure 22:
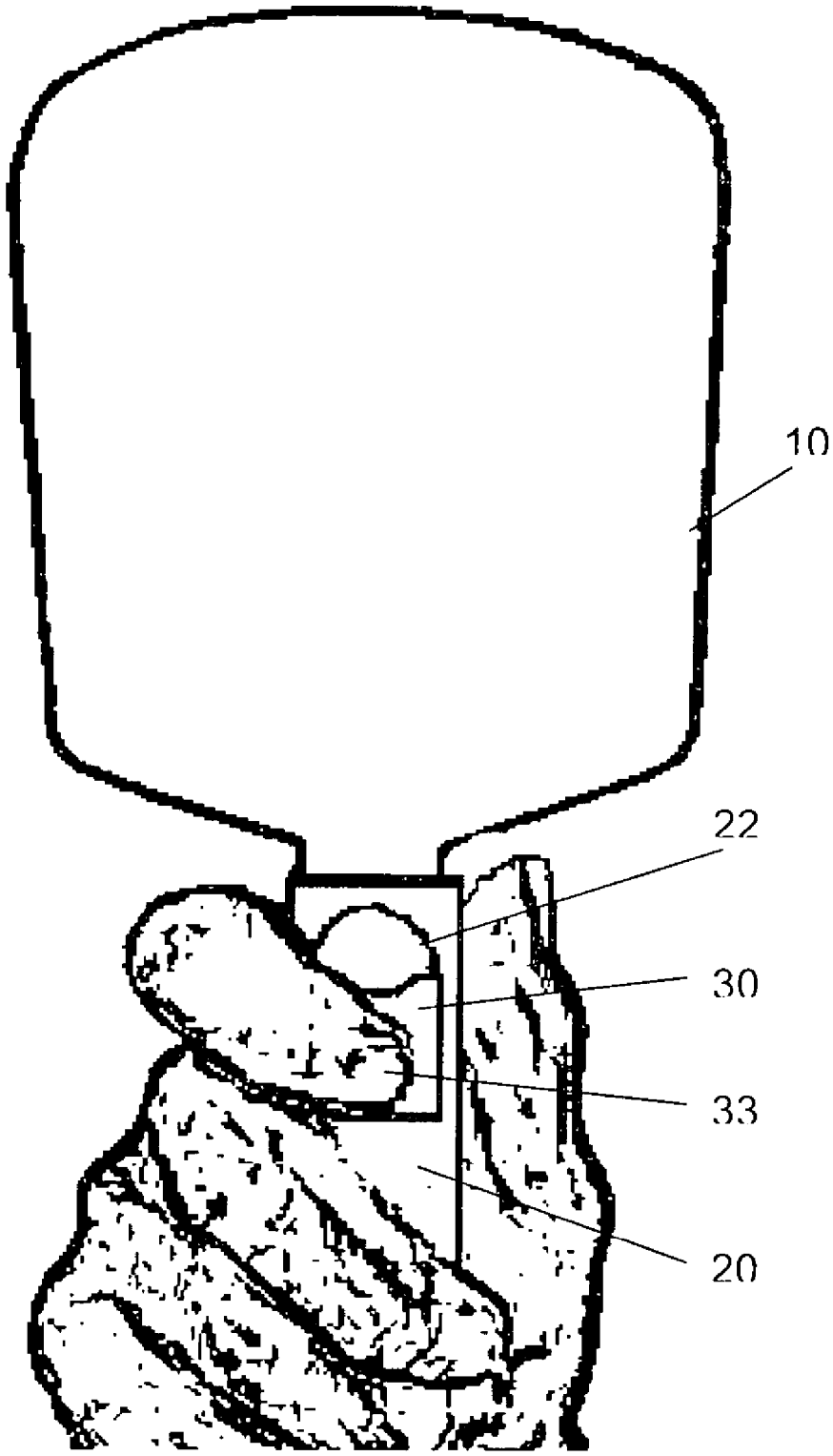
FIG. 22 illustrates the use of an exemplary trigger mechanism in an exemplary percussion instrument and noisemaking device, according to an embodiment of the present invention.

FIG. 22 illustrates the use of an exemplary trigger mechanism in an exemplary percussion instrument and noisemaking device, according to an embodiment of the present invention. FIG. 22 shows, by way of example and not by way of limitation, how the device can produce additional sounds when a user uses an index finger 33 to exert different amounts of pressure on flexible plate 30. Placing index finger 33 through front opening 22 of handle 20 allows the user to trigger additional sounds while moving paddle 10 back and forth. The sounds created using this method can range from an assortment of soft, low-pitched muffled clicking to a series of loud, high-pitched popping.

FIG. 23 illustrates the sound flow from an exemplary percussion instrument and noisemaking device, according, to an embodiment of the present invention. FIG. 23 shows, by way of example and not by way of limitation, how sound flows from front opening 22 and top opening 21 of handle 20. Front opening 22 of handle 20 allows the user to direct most of the sound forward in the direction of an arrow 22A. A limited amount of sound escapes from top opening 21 of handle 20, moving upward in the direction of an arrow 21A.

A user can also create additional sounds by partially covering or fully covering front opening 22 or handle 20, thus restricting the sound allowed to resonate from the device. Also, increasing the speed and force of the back and forth movement of paddle 10 may change the intensity of the sound.

In alternate embodiments of the present invention handle 20 may be redesigned, fully closing front opening 22 or making front opening 22 larger, smaller or by adding multiple openings to handle 20. It is also understood that one could increase or decrease the sounds created by changing the diameter of indention 31 in flexible plate 30, by changing the size and thickness of flexible plate 30, or by drilling holes into flexible plate 30. In other alternate embodiments, paddle 10, handle 20, flexible plate 30 and brace 40 may be constructed of alternate materials such as, but not limited to, plastic, wood, metal or some other suitable material.

Figures 24, 25, 26:
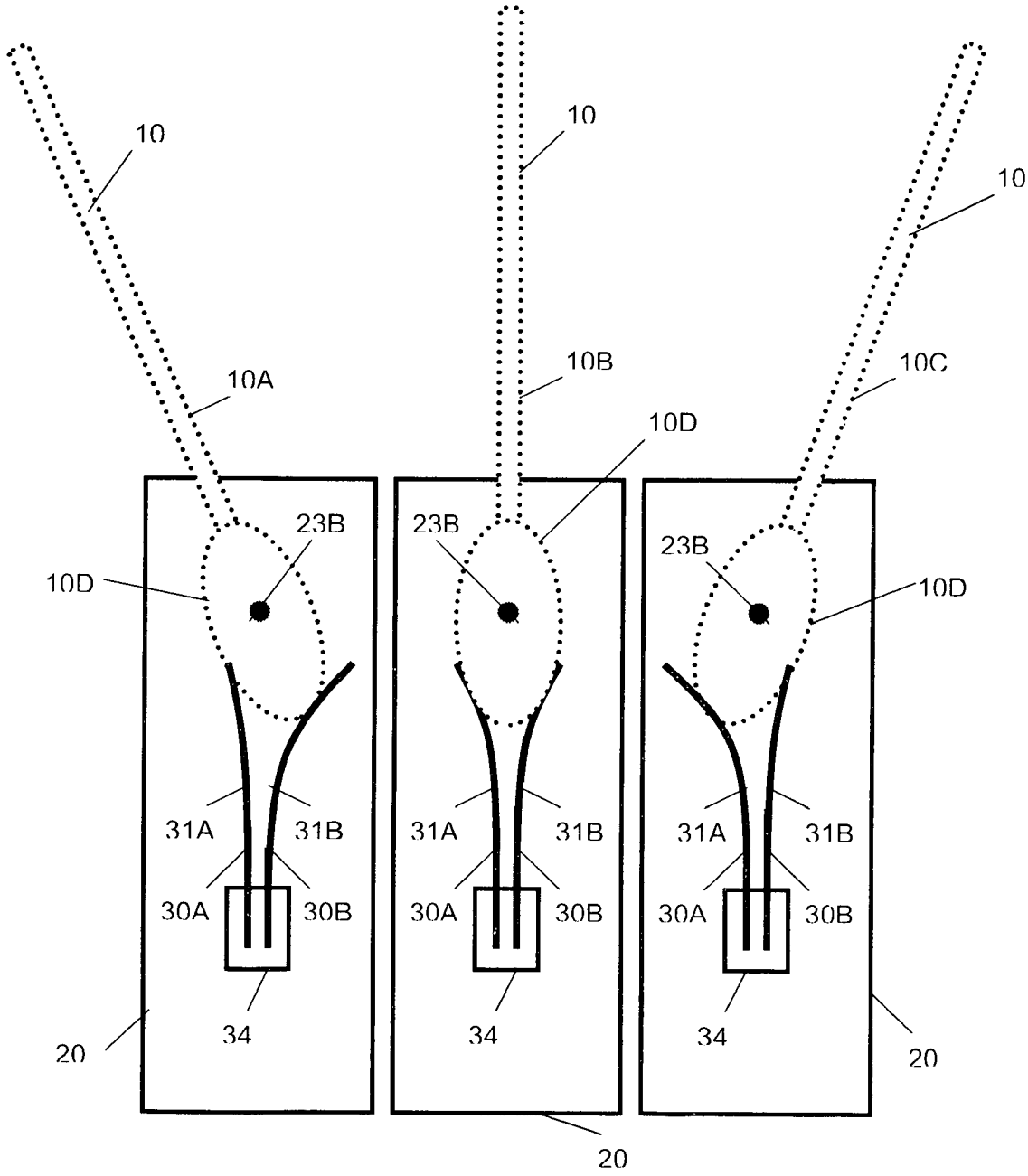
FIG. 24, FIG. 25 and FIG. 26 illustrate interior views of an exemplary percussion instrument and noisemaking device with multiple flexible plates, in accordance with an embodiment of the present invention.

FIG. 24, FIG. 25 and FIG. 26 illustrate interior views of an exemplary percussion instrument and noisemaking device with multiple flexible plates 30A and 30B, in accordance with an embodiment of the present invention. FIG. 24 shows a view with a paddle 10 in a forward position 10A; FIG. 25 shows paddle 10 in a neutral position 10B; and FIG. 26 shows paddle 10 in a backward position 10C. FIG. 24 illustrates, by way of example and not by way of limitation, paddle 10 and flexible plates 30A and 30B in forward paddle position 10A inserted into a handle 20. FIG. 24 illustrates how an alternative design of one end of paddle 10 pivoting on an axis 23B causes a lower end 10D of paddle 10 to bend flexible plate 30B when paddle 10 is in forward paddle position 10A causing an indention 31B on flexible plate 30B to create a sound. Furthermore, flexible plates 30A and 30B are held in place by an anchor 34. Anchor 34 may be one of a variety of means including, but not limited to, glue, a block that flexible plates 30A and 30B are inserted into, a clamp, a screw, and etc.

FIG. 25 illustrates, by way of example and not by way of limitation, paddle 10 in neutral position 10B and flexible plates 30A and 30B inserted into handle 20. FIG. 25 illustrates how the pivoting of paddle 10 on axis 23B while in neutral position 10B also allows flexible plates 30A and 30B and indentions 31A and 31B on flexible plates 30A and 30B to remain in a neutral position. In addition, lower end 10D of paddle 10 is inserted between flexible plates 30A and 30B, and flexible plates 30A and 30B are held in place by anchor 34.

FIG. 26 illustrates, by way of example and not by way of limitation, paddle 10 and flexible plates 30A and 30B inserted into handle 20 in backward paddle position 10C. FIG. 26 illustrates how the pivoting of paddle 10 on axis 23B causes lower portion 10D of paddle 10 to bend flexible plate 30A when paddle 10 is in backward paddle position 10C causing indention 31A to create a sound. Furthermore, flexible plates 30A and 30B are held in place by anchor 34.

Figures 27, 28, 29:
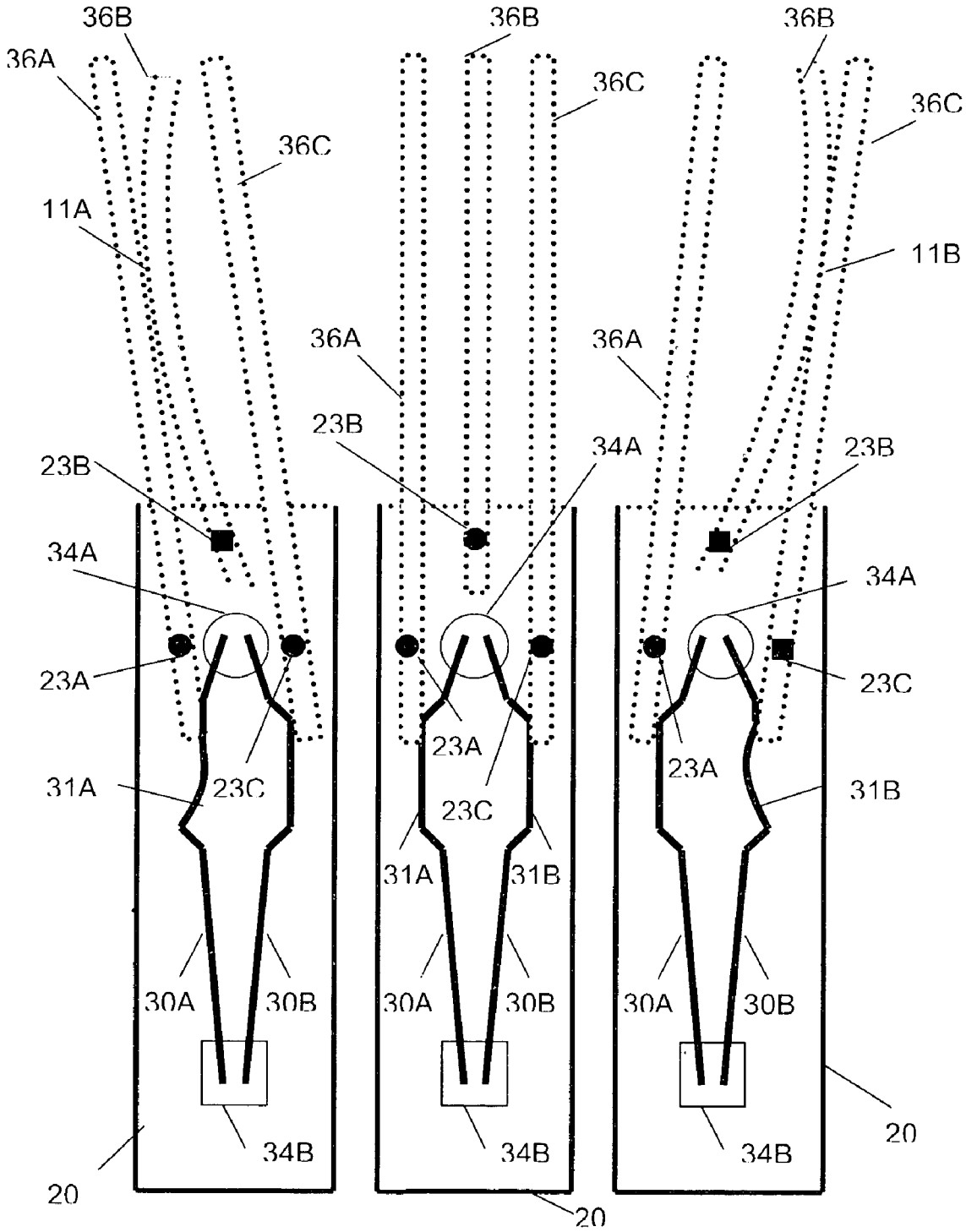
FIG. 27, FIG. 28 and FIG. 29 illustrate interior views of an exemplary percussion instrument and noisemaking device with multiple paddles, in accordance with an embodiment of the present invention.

FIG. 27, FIG. 28 and FIG. 29 illustrate interior views of an exemplary percussion instrument and noisemaking device with multiple paddles 36A, 36B, and 36C, in accordance with an embodiment of the present invention. FIG. 27 shows paddles 36A, 36B, and 36C in the forward position; FIG. 28 shows paddles 36A, 36B, and 36C in the neutral position; and FIG. 29 shows paddles 36A, 36B, and 36C in the backward position. FIG. 27 illustrates, by way of example and not by way of limitation, multiple paddles 36A, 36B, 36C in the forward position, and flexible plates 30A and 30B inserted into a handle 20. In the present embodiment, flexible plates 30A and 30B are similar to prior art flexible plates disclosed by Molenaar. Paddles 36A, 36B and 36C pivot on axes 23A, 23B and 23C, respectively, causing paddle 36A to bend flexible plate 30A when paddle 36A is in the forward paddle position causing an indention 31A to create a sound.

Center paddle 36B does not make contact with flexible plates 30A or 30B. Because center paddle 36B moves freely on axis 23B and is made of a flexible or non-flexible material such as but not limited to, rubber, plastic, metal, wood, cardboard, and etc., center paddle 36B is able to make contact with front paddle 36A at a forward position 11A. Likewise, center paddle 36B is able to make contact with rear paddle 36C at a backward position 11B, as shown in FIG. 29. The present multiple paddle design is able to generate numerous sounds depending on the material used for center paddle 36B compared to outside paddles 36A and 36C and the material used for the flexible plates 30A and 30B. Examples of materials that would be suitable for outer paddles 36A and 36C are, without limitation, rigid plastic, wood, metal, etc. Examples of materials that would be suitable for flexible plates 30A and 30B are, without limitation, metal, plastic, etc. Furthermore, FIG. 27 illustrates how flexible plates 30A and 30B are held in place by anchors 34A and 34B. Anchors 34A and 34B may be of a variety of means including, but not limited to, glue, blocks that flexible plates 30A and 30B are inserted into, clamps. screws, etc.

FIG. 28 illustrates, by way of example and not by way of limitation, paddles 36A, 36B and 36C in the neutral position, and flexible plates 30A, 30B inserted into handle 20. FIG. 28 illustrates how, when paddles 36A, 36B and 36C are in a neutral position, the device allows flexible plates 30A and 30B and indentions 31A and 31B on flexible plates 30A and 30B to remain in a neutral position. Furthermore, FIG. 28 illustrates how flexible plates 30A and 30B are held in place by anchors 34A and 34B.

FIG. 29 illustrates, by way of example and not by way of limitation, paddles 36A, 36B and 36C in the backward position, and two flexible plates 30A, 30B inserted into handle 20. Paddles 35A, 36B and 36C pivot on axes 23A, 23B and 23C, respectively, causing paddle 36C to bend flexible plate 30B when paddle 36C is in the backward paddle position causing indention 31B on flexible plate 30B to create a sound. Center paddle 36B does not make contact with flexible plates 30A or 30B. Because center paddle 36B moves freely on pivot 23B, center paddle 36B is able to make contact with back paddle 36C at backward position 11B. Likewise, center paddle 36B is able to make contact with front paddle 36A at forward position 11A, as shown in FIG. 27. This multiple paddle design is able to generate numerous sounds depending on the material used for center paddle 36B compared to the outside paddles 36A and 36C and the material used for flexible plates 30A and 30B.

Figures 30, 31, 32:
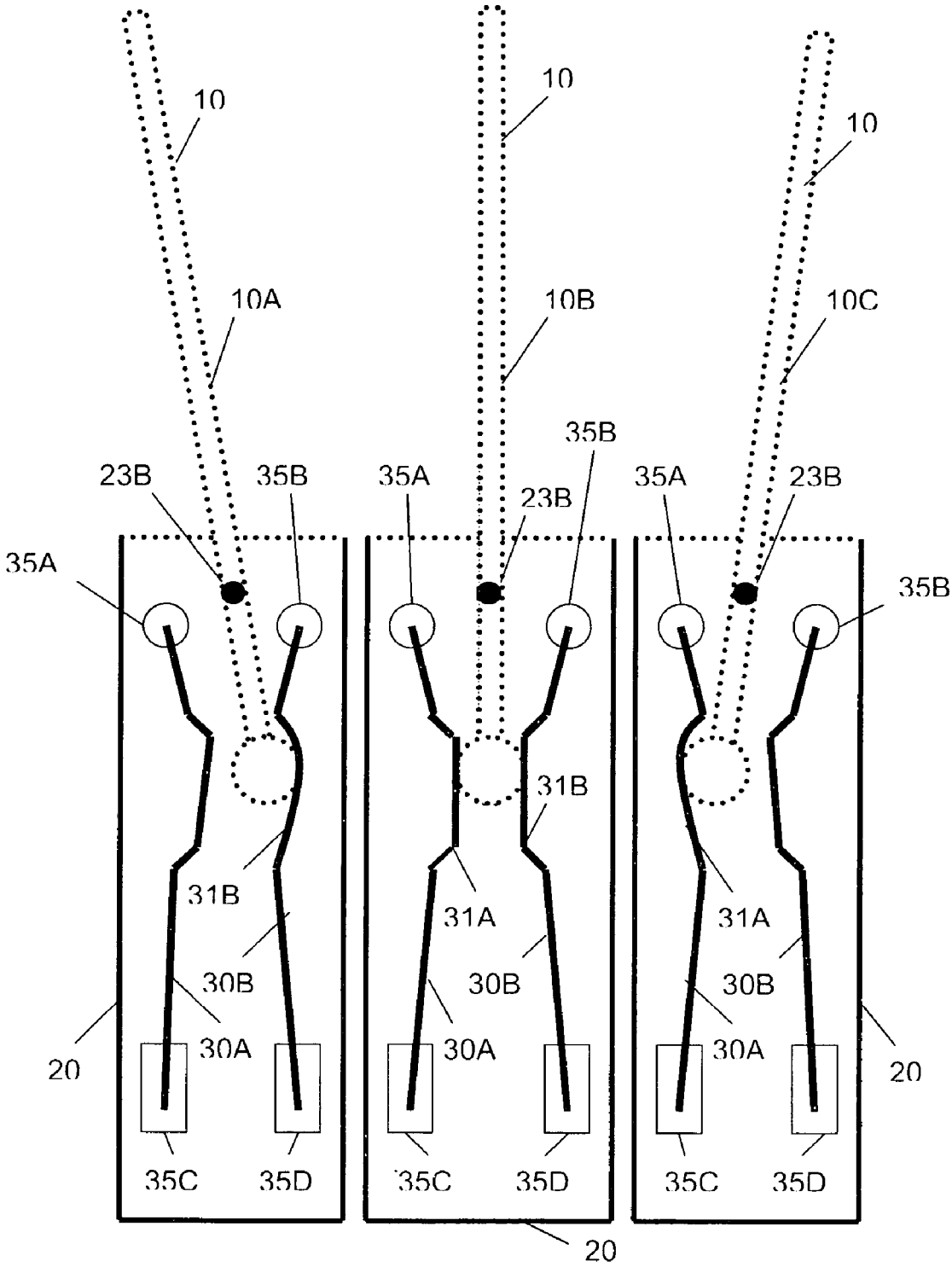
FIG. 30, FIG. 31 and FIG. 32 illustrate interior views of a exemplary percussion instrument and noisemaking device, in accordance with an embodiment of the present invention.

FIG. 30, FIG. 31 and FIG. 32 illustrate interior views of an exemplary percussion instrument and noisemaking device, in accordance with an embodiment or the present invention. FIG. 30 shows a paddle 10 in a forward position 10A; FIG. 31 shows paddle 10 in a neutral position 10B; and FIG. 32 shows paddle 10 in a backward position 10C. In the present embodiment, paddle 10 and flexible plates 30A and 30B are inserted into a handle 20. Flexible plates 30A and 30B are similar to those disclosed by Molenaar. FIG. 30 illustrates how an alternative design of one end of paddle 10 pivoting on an axis 23B, causing paddle 10 to bend flexible plate 30B when paddle 10 is in forward paddle position 10A, causes an indention 31B to create a sound. Furthermore, flexible plates 30A and 30B are held in place by anchors 35A, 35B, 35C and 35D. Anchors 35A, 35B, 35C, and 35D may be of a variety of means including, but not limited to, glue, blocks that flexible plates 30A and 30B are inserted into, clamps, screws, etc.

FIG. 31 illustrates, by way of example and not by way of imitation, paddle 10 and flexible plates 30A and 30B in the neutral position; inserted into handle 20. FIG. 31 illustrates how paddle 10, when in neutral paddle position 10B, allows flexible plates 30A and 30B and indentions 31A and 31B in flexible plates 30A and 30B to also remain in a neutral position. Furthermore, FIG. 31 illustrates how flexible plates 30A and 30B are held in place by anchors 35A, 35B, 35C and 35D.

FIG. 32 illustrates, by way of example and not by way of limitation, paddle 10 and flexible plates 30A and 30B in backward position 10C inserted into handle 20. FIG. 32 illustrates paddle 10 pivoting, on axis 23B, causing paddle 10 to bend flexible plate 30A when paddle 10 is in backward paddle position 10C, thus causing indention 31A to create a sound. Furthermore, FIG. 32 illustrates how flexible plates 30A and 30B are held in place by anchors 35A, 35B, 35C and 35D.

Figures 33, 34, 35:
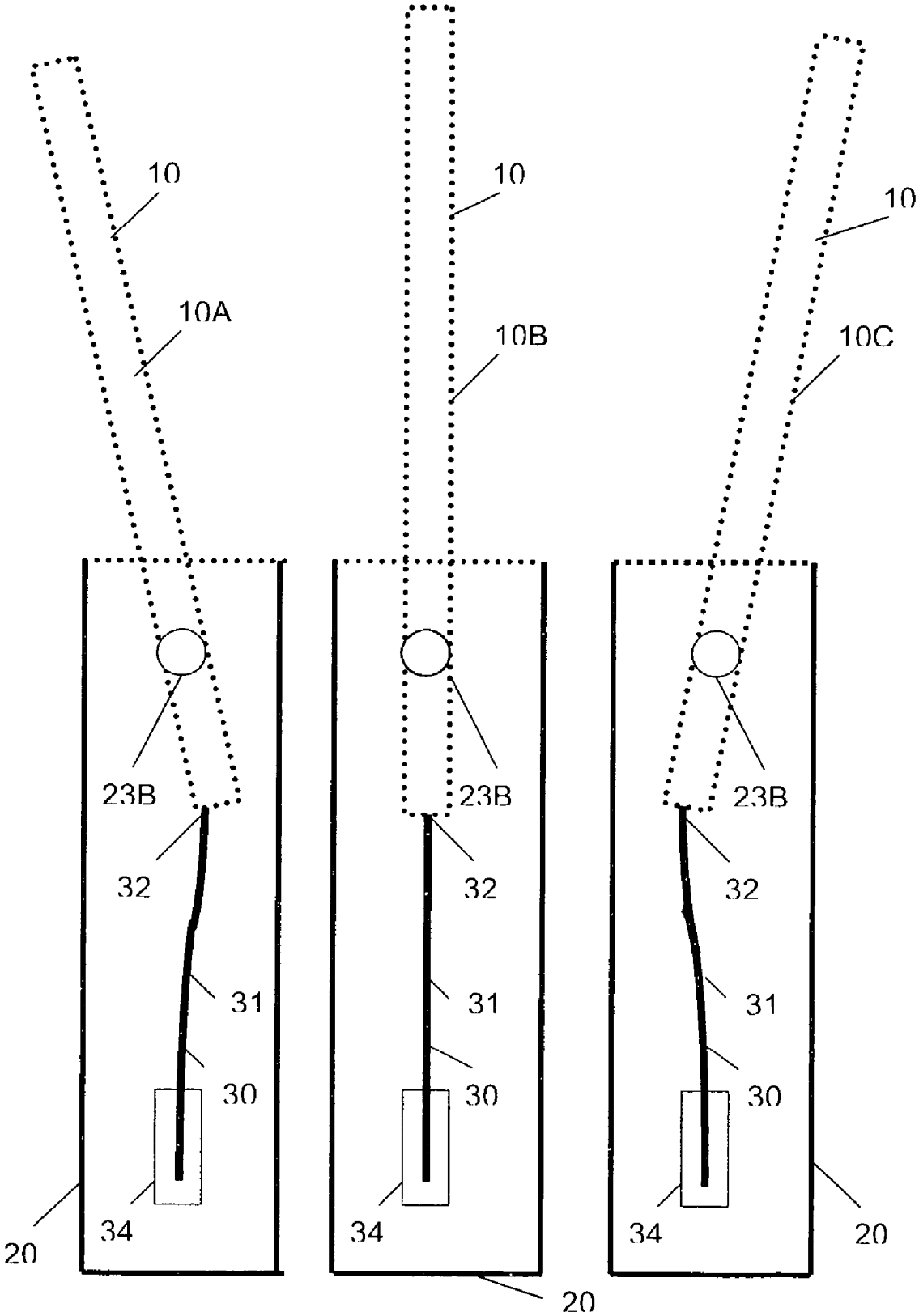
FIG. 33, FIG. 34 and FIG. 35 illustrate interior views of an exemplary percussion instrument and noisemaking device, in accordance with an embodiment of the present invention.

FIG. 33, FIG. 34 and FIG. 35 illustrate interior views of an exemplary percussion instrument and noisemaking device, in accordance with an embodiment of the present invention. FIG. 33 shows a paddle 10 in a forward position 10A: FIG. 34 shows paddle 10 in a neutral position 10B; and FIG. 35 shows paddle 10 in a backward position 10C. FIG. 33 illustrates, by way of example and not by way of limitation, paddle 10 and a flexible plate 30 inserted into a handle 20 and in forward position 10A. FIG. 33 illustrates how paddle 10 pivots on an axis 23B causing paddle 10 to bend flexible plate 30 when paddle 10 is in forward paddle position 10A, thus causing an indention 31 on flexible plate 30 to create a sound. Furthermore, one end of flexible plate 30 is held in place by an anchor 34. The other end of the flexible plate 30 is attached to paddle 10 and held in place by anchor 32. Anchor 32 and anchor 34 may be one of a variety of means including, but not limited to, glue, a block that flexible plates 30A and 30B are inserted into, a clamp, a screw etc.

FIG. 34 illustrates paddle 10 and flexible plate 30 in neutral position 10B inserted into handle 20. FIG. 34 illustrates how when paddle 10 is in neutral paddle position 10B and when paddle 10 is not moving on axis 23B, flexible plate 30 and indention 31 on flexible plate 30 are also in a neutral position. Furthermore, FIG. 34 illustrates how flexible plate 30 is held in place by anchor 34. The other end of the flexible plate is attached to paddle 10 and held in place by anchor 32.

FIG. 35 illustrates, by way of example and not by way of limitation, paddle 10 and flexible plate 30 inserted into handle 20 and in backward position 10C. FIG. 35 illustrates how paddle 10 pivots on axis 23B causing paddle 10 to bend flexible plate 30 when paddle 10 is in backward paddle position 10C, thus causing indention 31 on flexible plate 30 to create a sound. Furthermore, flexible plate 30 is held in place by anchor 34. The other end of the flexible plate is attached to paddle 10 and held in place by anchor 32.

Figure 39:
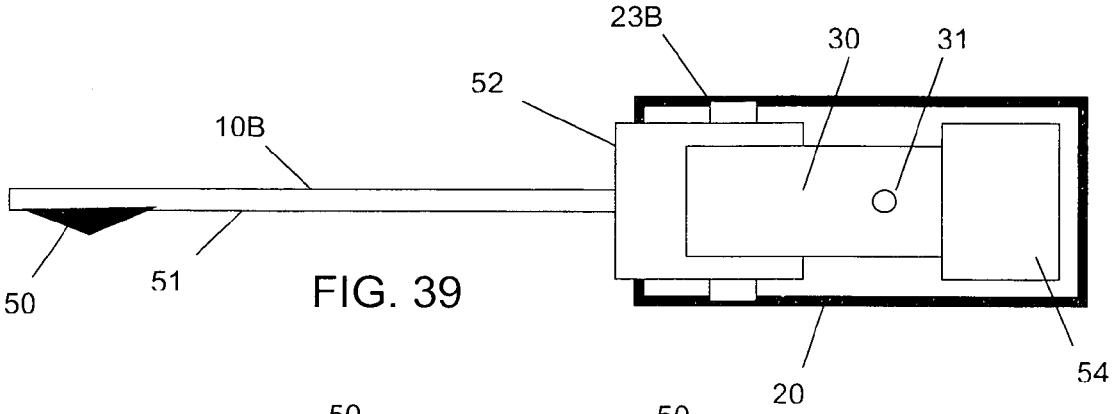
FIG. 36, FIG. 37, FIG. 38 and FIG. 39 illustrate cross sectional views of an exemplary percussion instrument and noisemaking device comprising a stick and a flag, in accordance with an embodiment of the present invention.
Figure 36:
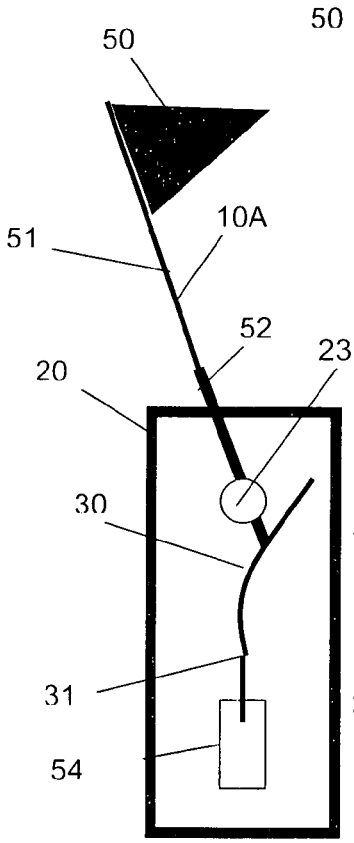
Figure 37:
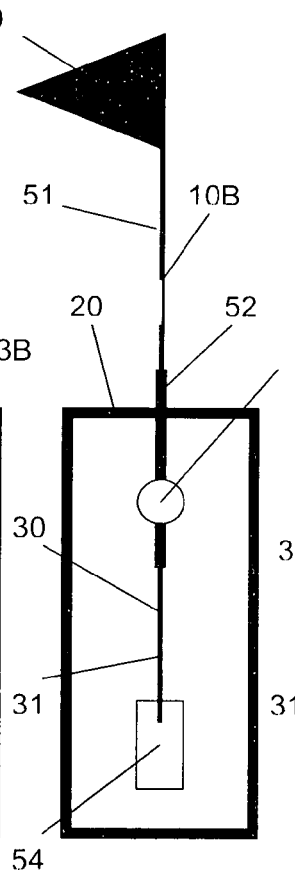
Figure 38:
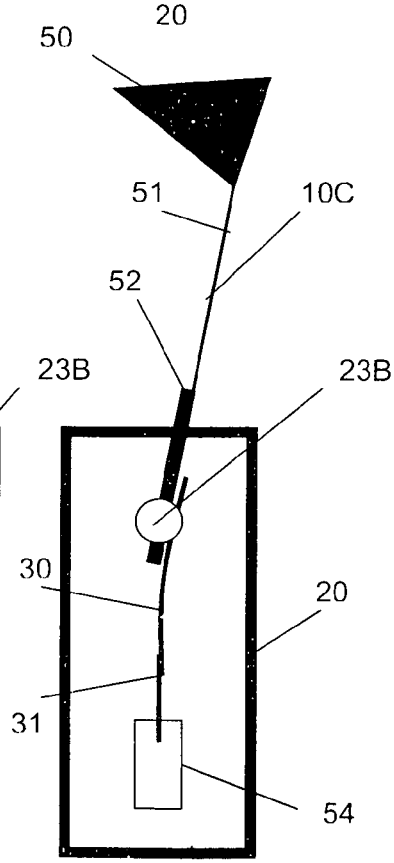

FIG. 36, FIG. 37, FIG. 38 and FIG. 39 illustrate cross-sectional views of an exemplary percussion instrument and noisemaking device comprising a flag 50, a stick 51, a stick neck 52 and an anchor 54, in accordance with an embodiment of the present invention. FIG. 36, FIG. 37 and FIG. 38 shows a side view of the device, and FIG. 38 shows the front view of the device. The present embodiment comprises flag 50 attached to stick 51 attached to a stick neck 52, and a flexible plate 30 with an indention 31 inserted into a handle 20. The present embodiment creates sound when stick 51 attached to stick neck 52 pivots on axis 23B causing stick neck 52 to bend flexible plate 30 causing indention 31 to create sound. FIG. 36 shows sticks 51 in a forward position 10A. FIG. 37 shows stick 51 in a neutral position 10B. FIG. 38 shows sticks 51 in backward position 10C. FIG. 39 shows stick 51 in a neutral position 10B. Furthermore, FIG. 36, FIG. 37, FIG. 38 and FIG. 39 illustrates how flexible plate 30 is held in place by anchor 54. Anchor 54 may be one of a variety of means including, but not limited to, glue, a block that flexible plate 30 is inserted into, clamp, a screw etc.

FIG. 37 illustrates by way of example and not by way of limitation, stick 51 and flexible plate 30 in neutral position 10B inserted into handle 20. FIG. 37 illustrates how when stick 51 is in neutral position 10B and when stick 51 is not moving on axis 23B, flexible plate 30 and indention 31 are also in a neutral position. Furthermore, FIG. 37 illustrates how flexible plate 30 is held in place by anchor 34.

FIG. 38 illustrates by way of example and not by way of limitation, stick 51 and flexible plate 30 inserted into handle 20 and in backward position 10C. FIG. 38 illustrates how stick 51 attached to stick neck 52 pivots on axis 23B causing indention 31 on flexible plate 30 to create sound. Furthermore, flexible plate 30 is held in place by anchor 34.

Yet other embodiments of the present invention create different sounds by changing the amount of pressure exerted on the flexible plate by, for example, without limitation, increasing or decreasing the size, shape and weight of the paddle or paddles. An example, without limitation, of increasing or decreasing the size, shape and weight of the paddle would be to use multiple paddles or replace the paddle with a stick holding a flag or pennant, as shown in FIG. 36 and FIG. 37, or to replace the paddle with a gun like trigger or string to bend the flexible plate. In some embodiments the paddle or paddles may be substituted with an object with another shape such as, but not limited to, a football, a baseball, four leaf clover, pumpkin, bottle, can container, etc. One could also change the pressure exerted on the flexible plate by repositioning the pivot holes and/or by allowing the paddle to not make contact with the top inside front edge of the handle and instead to allow the paddle to make contact with the rear inside edge of the handle. It is also possible to change the sound created and the amount of sound created by attaching paddles to both ends of the handle and/or by adding more than one flexible plate and more than one indention to the flexible plate. It is also possible to activate the flexible plate by holding the paddle instead of the handle. Holding the paddle and forcing the handle to move backward and forward can also cause the paddle to bend the flexible plate causing the indention to create sound. Those skilled in the art, in light of the present teachings, will readily recognize other useful ways to adapt the present invention in light of the prior art previously mentioned. One example, of which is to substitute the flexible plate with a flexible plate similar to the type used by Molenaar as illustrated earlier.

At least one embodiment will next be described and show that implements a flexible plate without the use of an indention as shown in prior embodiments. It is contemplated that in some practical application, such indentionless embodiments could be relatively more easily and cheaply produced.

Figure 40:
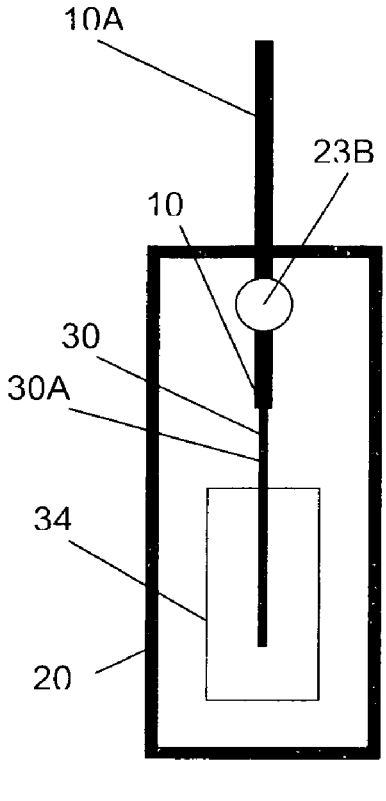
FIG. 40, FIG. 41, FIG. 42, FIG. 43, FIG. 44 and FIG. 45 illustrate cross sectional views of an exemplary percussion instrument and noisemaking device in accordance with an embodiment of the present invention.
Figure 41:
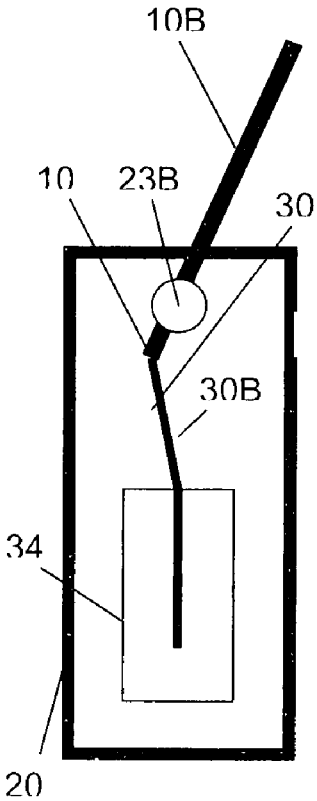
Figure 42:
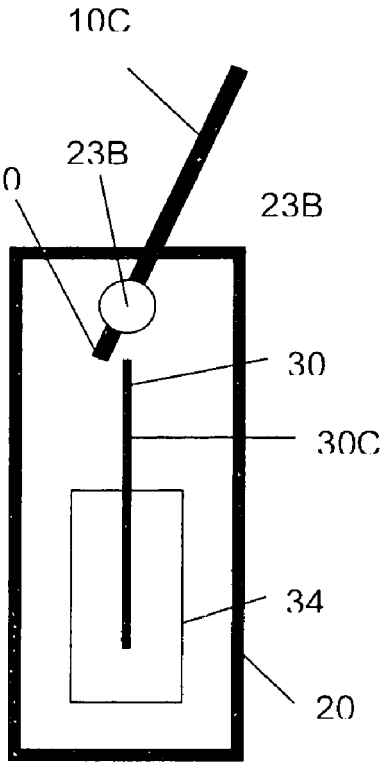
Figure 43:
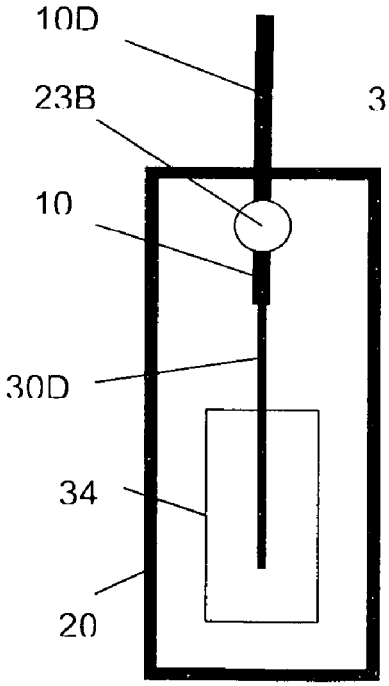
Figure 44:
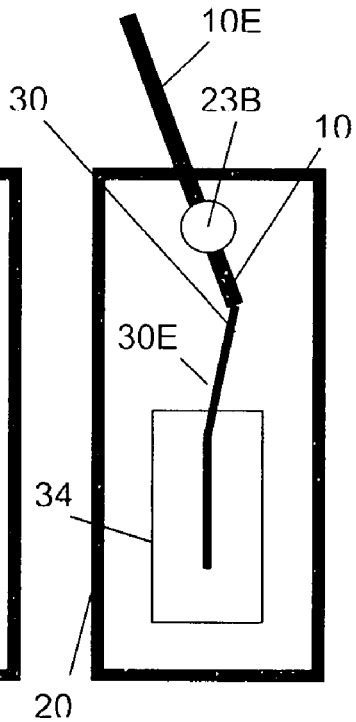
Figure 45:
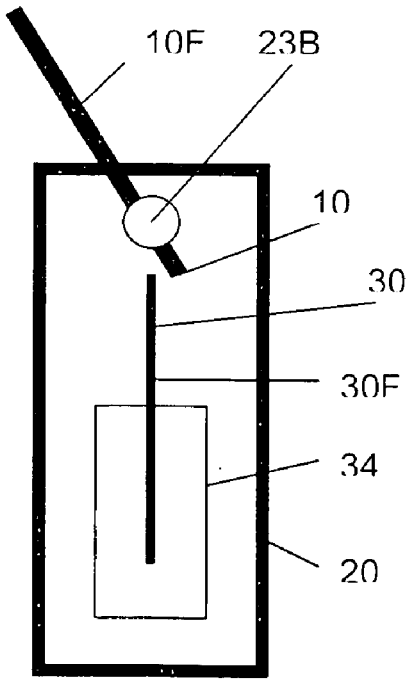

FIG. 40, FIG. 41, FIG. 42, FIG. 43, FIG. 44 and FIG. 45 illustrate interior views of an exemplary percussion instrument and noisemaking device, in accordance with an embodiment of the present invention. FIG. 40 shows a paddle 10 in a neutral position 10A; FIG. 41 shows paddle 10 moving towards a backward position 10B; FIG. 42 shows paddle 10 in a backward position 10C; FIG. 43 shows paddle 10 in a neutral position 10D; FIG. 44 shows paddle 10 moving towards a forward position 10E; and FIG. 45 shows paddle 10 in a forward position 10F. FIG. 40 illustrates, by way of example, and not by way of limitation, paddle 10 and a flexible plate 30 inserted into a handle 20 with paddle 10 in the neutral position 10A and flexible plate 30 in a neutral position 30A. Furthermore, FIG. 40 illustrates how flexible plate 30 is held in place by an anchor 34. FIG. 41 illustrates how paddle 10 pivots on an axis 23B moving towards the backward position 10B bending flexible plate 30 in a backward position 30B. FIG. 42 illustrates how paddle 10 pivots on axis 23B in the backward position 10C releasing flexible plate 30 to create sound causing flexible plate 30 to return to a neutral position 30C. Furthermore, FIG. 42 illustrates how flexible plate 30 is held in place by anchor 34. FIG. 43 illustrates how when paddle 10 is in the neutral position 10D and when paddle 10 is not moving on axis 23B, flexible plate 30 is also in a neutral position 30D. Furthermore, FIG. 43 illustrates how flexible plate 30 is held in place by anchor 34. FIG. 44 illustrates how paddle 10 pivots on axis 23B moving towards the forward position 10E bending flexible plate 30 in the forward position 30E. Furthermore, FIG. 44 illustrates how flexible plate 30 is held in place by anchor 34. FIG. 45 illustrates how paddle 10 pivots on axis 23B in the forward position 10F releasing flexible plate 30 to create sound causing flexible plate 30 to return to a neutral position 30F. Furthermore, FIG. 45 illustrates how flexible plate 30 is held in place by anchor 34.

It is to be understood that the relationship of the parts and their dimensions include variations in size, materials, shape, form, function and manner of operation, assembly and use, and are deemed readily apparent and obvious to one skilled in the art. It is further understood that an equivalent relationships illustrated in the drawings and described in the specifications are intended to be encompassed by the present invention. The illustrative drawings and the specifications described are not intended to limit the invention to the exact construction and operation shown and described since numerous modifications and changes will readily occur to those skilled in the art.

Having fully described at least one embodiment of the present invention, other equivalent or alternative percussion instrument and noisemaking devices according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A percussion instrument and noisemaking device comprised of:

at least one blade member having a handle joining portion at its base;

a flexible plate member operable for making sound, said flexible plate member having a generally circular indention that is operable for producing a sound when said flexible plate member is flexed about said indention; and a handle comprising an upper portion which is hollow, said upper portion configured to receive and join to a lower portion of said flexible plate member, thereby containing all of said flexible plate member within said hollow upper portion, said upper portion further configured to be pivotably joined to a lower portion of said at least one blade such that said at least one blade member pivots when said handle is translated perpendicular to the plane of said at least one blade, and said at least one blade and said flexible plate member being oriented such that when said at least one blade pivots, said at least one blade causes said flexible plate member to flex and thereby flex said indentation to make a sound emanating about said indentation.

2. The device of claim 1, in which said lower portion of said at least one blade member is a generally narrow protruding neck that is operable to be received into said handle.

3. The device of claim 2, further comprising a pivoting mechanism in which said neck comprises at least one pivot joint member and said handle comprises a complementary pivoting joint receiving member, both of which properly mate for pivotably joining said at least one blade to said handle.

4. The device of claim 1, in which said lower portion of said flexible plate member is made of a metal or a plastic.

5. The device of claim 1, in which said upper handle portion comprises at least one hole generally opening in the direction of said translation, said at least one hole being operable for channeling in said direction of translation any sound produced by said flexible plate and being configured to allow an index finger be inserted into said upper handle to exert varying amounts of pressure on said flexible plate member to trigger additional sounds.

6. The device of claim 1, in which said at least one blade is further a generally elongated member having an object joined thereto.

7. The device of claim 6, in which said object is shaped as a flag, a football, a pennant, a baseball, a bottle, or a can container.

8. The device of claim 1, further comprising a bracing member joined to a top of said upper handle portion bracing said upper handle portion such that said bracing member is operable to strengthen said top of said upper handle portion from breakage when said handle is normally translated forwards and/or backwards.

9. The device of claim 1, in which said at least one blade is formed of a relatively non-compliant material.

10. The device of claim 1, in which said sounds produced by said indentation are low-pitched, clicking sounds and alternative, louder, high-pitched clicking sounds.

11. The device of claim 1, in which said flexible plate member, said indention, and said lower blade portion pivotal joining all are cooperatively configure together such that a gentle flapping handle translation motion causes said flexible plate member to produce a first set of one or more sounds, while a more vigorous flapping handle translation motion causes said flexible plate member to produce a second set of one or more sounds.

12. The device of claim 1, farther comprising another flexible plate member having a generally circular indentation, said another flexible plate member disposed on an opposite side of said at least one blade such that said at least one blade causes said other flexible plate member to flex and thereby make a sound when said at least one blade pivots to an opposite extreme.

13. The device of claim 1, in which said blade is generally broad and generally flat.

* * * * *